US007899385B2

(12) United States Patent
Koga et al.

(10) Patent No.: US 7,899,385 B2
(45) Date of Patent: Mar. 1, 2011

(54) IMAGE FORMING APPARATUS

(75) Inventors: Yuji Koga, Nagoya (JP); Daisuke Kozaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 894 days.

(21) Appl. No.: 11/614,666

(22) Filed: Dec. 21, 2006

(65) Prior Publication Data

US 2007/0154249 A1 Jul. 5, 2007

(30) Foreign Application Priority Data

Dec. 22, 2005 (JP) ..... 2005-370246

(51) Int. Cl.
*G03G 15/00* (2006.01)

(52) U.S. Cl. ..... 399/388; 399/400

(58) Field of Classification Search ..... 399/388, 399/400

See application file for complete search history.

(56) References Cited

U.S. PATENT DOCUMENTS

| | | | | |
|---|---|---|---|---|
| 6,792,242 | B2 * | 9/2004 | Suzaki | 399/392 |
| 2004/0100014 | A1 * | 5/2004 | Furukawa | 271/113 |
| 2006/0038338 | A1 * | 2/2006 | Lin | 271/10.04 |
| 2006/0072951 | A1 * | 4/2006 | Kim et al. | 399/388 |

FOREIGN PATENT DOCUMENTS

| | | | | |
|---|---|---|---|---|
| JP | 05058481 | A | * | 3/1993 |
| JP | H05-092839 | A | | 4/1993 |
| JP | H08-268579 | A | | 10/1996 |
| JP | H10-310270 | A | | 11/1998 |
| JP | 2002-046874 | A | | 2/2002 |
| JP | 2002037474 | A | * | 2/2002 |
| JP | 2000-0335758 | A | | 12/2005 |

OTHER PUBLICATIONS

Machine translation of JP 05-092839, Ikeda, Yasuhiko.*
Machine translation of JP 05-058481, Nogami, Yutaka.*
Japan Patent Office, Notice of Reasons for Rejection in priority Patent Appl'n No. JP 2005-370246 issued on Oct. 28, 2008.

* cited by examiner

*Primary Examiner*—Daniel J Colilla
*Assistant Examiner*—Allister Primo
(74) *Attorney, Agent, or Firm*—Baker Botts L.L.P.

(57) ABSTRACT

An image forming apparatus including a medium storage portion, a supply roller, a conveyance roller, a drive device and a transmission device is provided. The supply roller is rotary driven in a forward direction as a rotating direction to convey the recording mediums to a position for image formation, thereby to supply the abutting uppermost recording medium to a conveyance path. The conveyance roller is rotary driven in a forward direction as a rotating direction to convey the recording mediums to a position for image formation, thereby to allow passage of the uppermost recording medium conveyed by the supply roller. In the image forming apparatus, a conveyance speed of the recording medium by the conveyance roller is adapted to be faster than a conveyance speed of the recording medium by the supply roller.

9 Claims, 22 Drawing Sheets

IMAGE FORMING APPARATUS

CROSS-REFERENCE TO RELATED APPLICATIONS

This application claims the benefit of Japanese Patent Application No. 2005-370246 filed Dec. 22, 2005 in the Japan Patent Office, the disclosure of which is incorporated herein by reference.

BACKGROUND

This invention relates to an image forming apparatus that forms an image on a sheet-like recording medium.

A conventional image forming apparatus (such as a printer) includes a medium storage unit (i.e. a sheet feed cassette or a sheet feed tray) that stores a recording medium such as a sheet and the like. This apparatus is designed to convey the recording medium stored in the medium storage unit to an image forming position (a position where an image is formed on the recording medium). Specifically, the conventional image forming apparatus includes a supply roller and a conveyance roller. The supply roller supplies the recording medium stored in the medium storage unit into a conveyance path. The conveyance roller conveys the recording medium after performing skew correction by temporarily restricting passage of the recoding medium conveyed by the supply roller in the conveyance path.

There is also a known printer as another type of image forming apparatus. The printer comprises a common motor to drive both a supply roller and a conveyance roller in order to achieve downsizing of the apparatus and cost reduction. In the printer, rotary driving force is transmitted such that while the supply roller is rotated in a forward direction (in a direction where a recording medium is conveyed toward an image forming position), the conveyance roller is rotated in a reverse direction. This configuration allows skew correction by the conveyance roller.

Specifically, the printer includes a first roller and a second roller. The first roller supplies a sheet stored in a sheet feed cassette to a conveyance path, and the second roller passes and further conveys the sheet conveyed by the first roller.

Also, the printer includes a feed roller, as a conveyance roller, that passes and further conveys the sheet conveyed by the second roller after performing skew correction. The feed roller is rotated in the reverse direction while both the first roller and the second roller are rotated in the forward direction to convey the sheet. When a leading end of the sheet conveyed by the second roller is pressed by the feed roller, a rotating direction of the motor is reversed. Thereby, the sheet conveyed by the second roller is conveyed after the feed roller performs skew correction.

When the sheet is conveyed to the second roller, a rotating shaft of the first roller is moved upward separating away from a surface of a sheet stored in the sheet feed cassette. Moreover, the second roller is configured so as to be stopped rotating and remain in a free state when the rotating direction of the motor is reversed. Accordingly, the first roller and the second roller do not interrupt conveyance of the sheet by the feed roller even when the rotating direction of the motor is reversed.

SUMMARY

In the above-described printer, however, each of the first roller and the second roller does not operate at least when a sheet is being conveyed by the feed roller, and thus a subsequent sheet cannot be supplied from the sheet feed cassette to the conveyance path. Accordingly, image printing on a plurality of sheets by the printer requires a long time. The printer, therefore, cannot satisfy a need to perform a large amount of printing in a short time.

As a solution to this problem, both the supply roller and the conveyance roller may be configured to be rotated in the forward direction thereby to allow the supply roller to supply a subsequent recording medium even when a preceding recording medium is being conveyed by the conveyance roller. Then, consecutive conveyance of a plurality of recording mediums may be achieved. In this case, the supply roller need not be separated or brought into a free state from the recording medium.

In the above-described consecutive conveyance, however, once the preceding recording medium being conveyed is skewed, the subsequent recording medium is likely to be affected. When a rear end of the recording medium being conveyed by the conveyance roller leaves the supply roller, the supply roller abuts the subsequent recording medium, and the subsequent recording medium is supplied to the conveying path. When the preceding recording medium being conveyed is skewed, a timing when the subsequent recording medium leaves the supply roller (in other words, a timing when the supply roller abuts the subsequent recording medium) is shifted in the rotating shaft direction. As a result, the subsequent recording medium is likely to be conveyed in a skewed state.

One aspect of the present invention may provide an image forming apparatus capable of inhibiting continuous occurrence of skew of a recording medium due to a consecutive conveyance of the recording medium by rotating both a supply roller and a conveyance roller in a forward direction.

In the one aspect of the present invention, there is provided an image forming apparatus including a medium storage portion, a supply roller, a conveyance roller, a drive device and a transmission device.

The medium storage portion is capable of storing a plurality of recording mediums in a stacked manner. The supply roller is disposed so as to abut an uppermost recording medium of the plurality of recording mediums stored in the medium storage portion. The supply roller is rotary driven in a forward direction as a rotating direction to convey the recording mediums to a position for image formation, thereby to supply the abutting uppermost recording medium to a conveyance path. The conveyance roller is disposed in the conveyance path. The conveyance roller is rotary driven in a forward direction as a rotating direction to convey the recording mediums to a position for image formation, thereby to allow passage of the uppermost recording medium conveyed by the supply roller. The drive device generates a rotary driving force. The transmission device transmits the rotary driving force generated by the drive device to the supply roller and the conveyance roller, thereby to cause both of the supply roller and the conveyance roller to rotate in the forward direction.

In the image forming apparatus, a conveyance speed of the recording medium by the conveyance roller is adapted to be faster than a conveyance speed of the recording medium by the supply roller.

BRIEF DESCRIPTION OF THE DRAWINGS

The invention will now be described below, by way of example, with reference to the accompanying drawings, in which.

DETAILED DESCRIPTION OF THE PREFERRED EMBODIMENTS

1. Description of Structure

Figure 1:
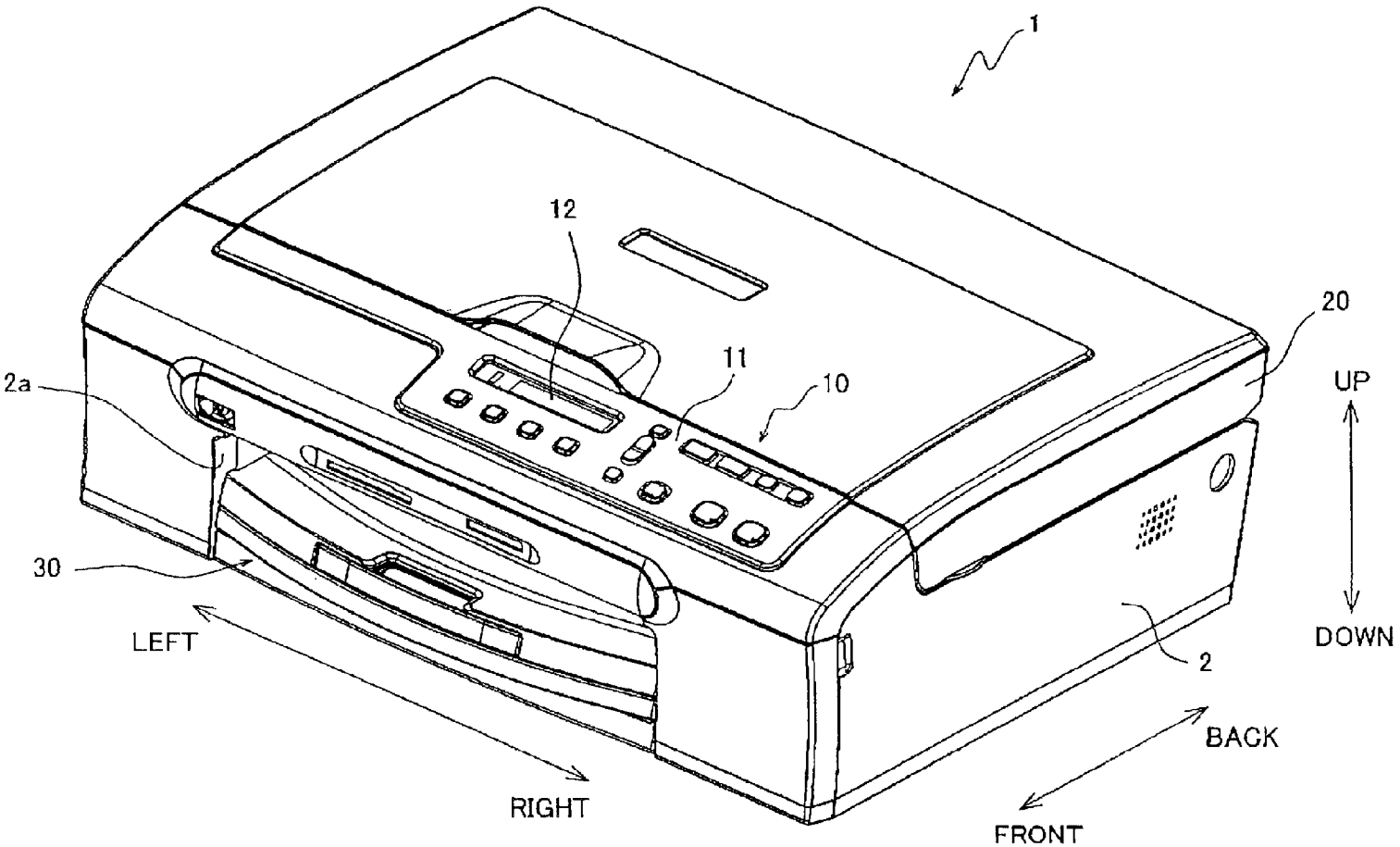
FIG. 1 is a diagrammatic perspective view showing an appearance of an image forming apparatus according to an embodiment of the present invention.

An image forming apparatus 1 of a present embodiment is a so-called multifunction apparatus including a printer function, a scanner function, a color copying function, a facsimile function. As shown in FIG. 1, the image forming apparatus 1 includes a body casing 2, which is made of resin and has a substantially rectangular box-shaped configuration.

An operation panel 10 is disposed in a front upper portion of the body casing 2. The operation panel 10 includes an operation portion 11 and a display portion (e.g., a liquid crystal display) 12. The operation portion 11 includes various operation buttons for input operation. The display portion 12 displays an image of a message and the like. Moreover, a scanner unit 20 that reads an image from a medium is disposed at a rear position of the operation panel 10. The scanner unit 20 is used for the scanner function, the color copying function and the facsimile function.

Figure 2:
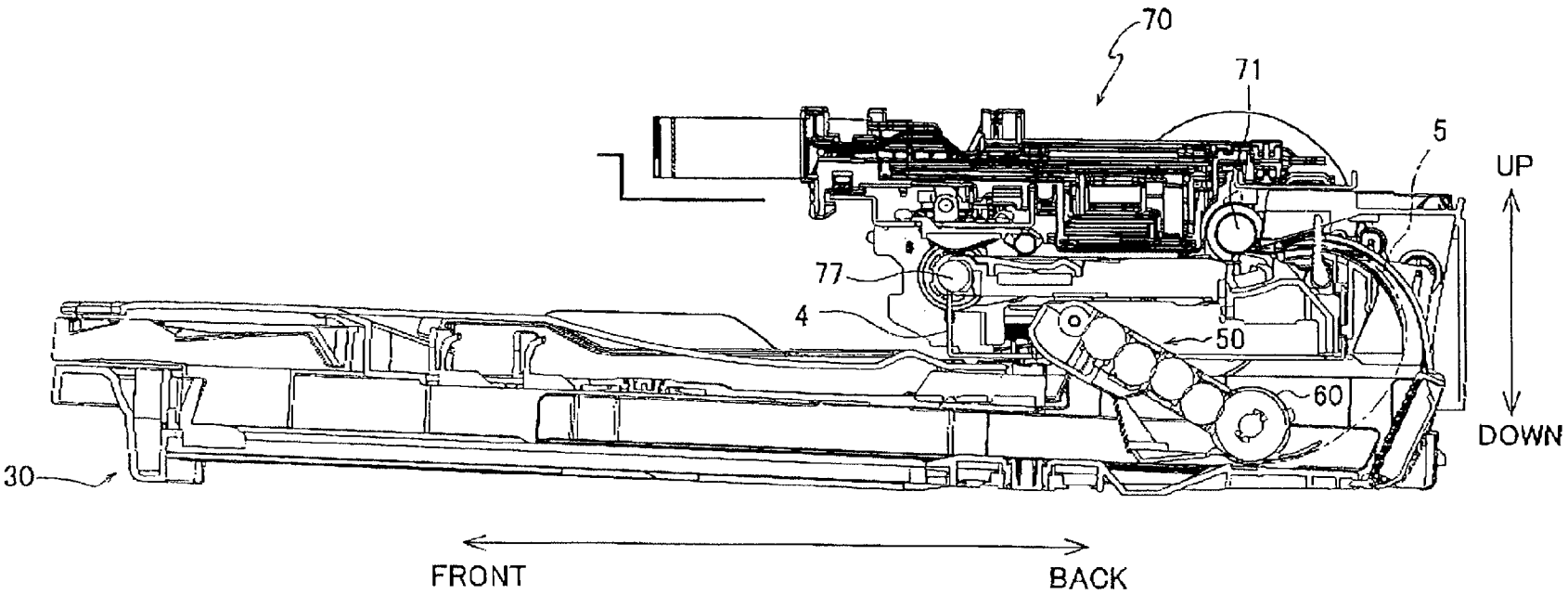
FIG. 2 is a schematic sectional side view of components provided in a body casing (excluding part of the components located in an upper area (e.g., a scanner unit))

At the bottom part inside the body casing 2, as shown in FIG. 2, a supply tray 30 is disposed. A plurality of sheets of a sheet-like recording medium, including, but not limited to paper sheets, plastic sheets and the like, can be stored substantially horizontally in the supply tray 30 in a stacked manner (accumulated manner). The supply tray 30 can be removed from the body casing 2 by horizontally pulling the supply tray 30 in a forward direction through an opening 2*a*, which is formed at a front face of the body casing 2 (see FIG. 1). In contrast, the supply tray 30 can be attached to the body casing 2 by horizontally inserting the supply tray 30 through the opening 2*a* of the body casing 2.

Figure 9:
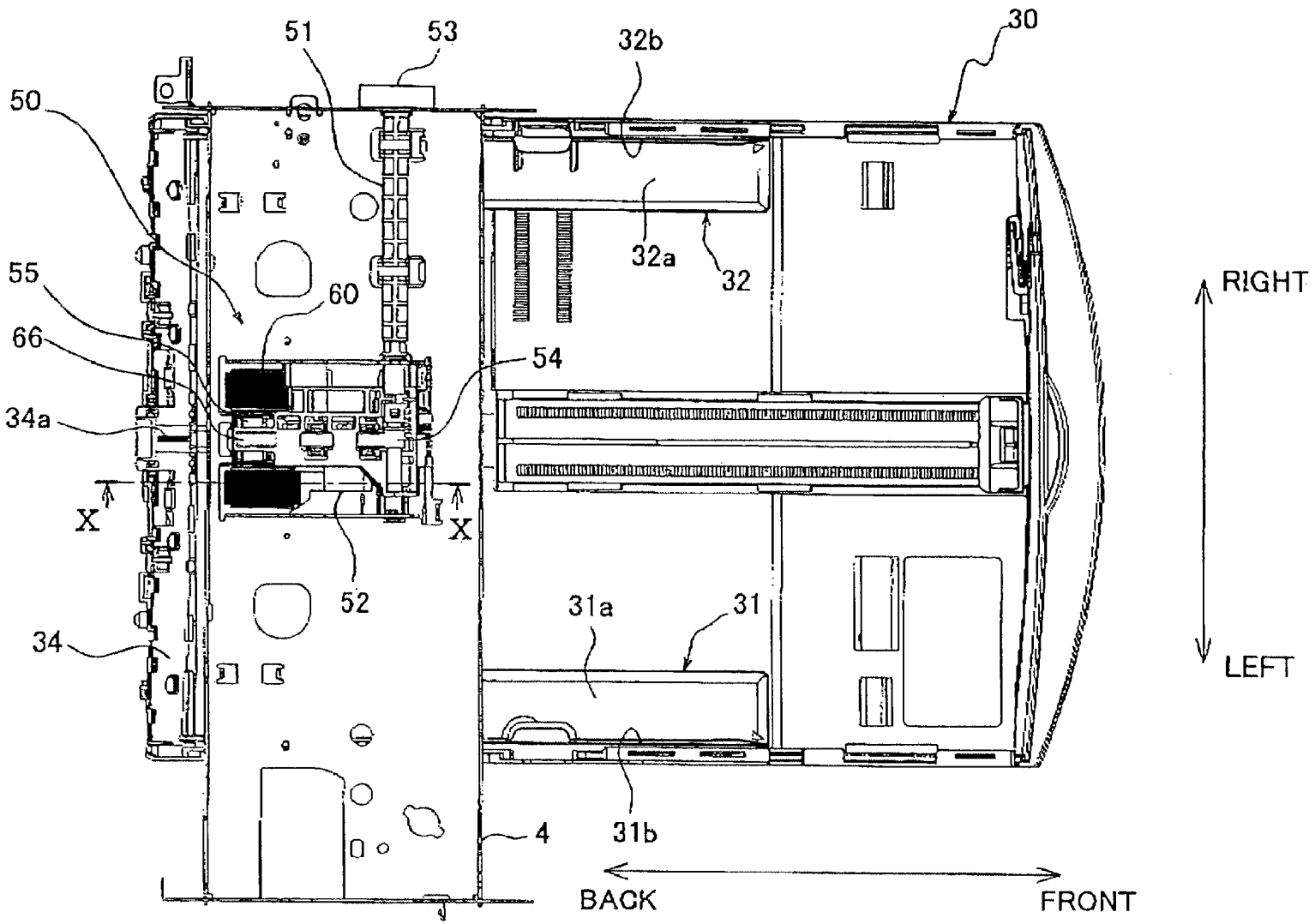
FIG. 9 is a plan view of the supply tray, the supply unit and a frame without the second tray being disposed.

A metallic box-like frame 4 (see FIGS. 9 and 11) is disposed in a rear portion inside the body casing 2 and above the supply tray 30. The metallic box-like frame 4 has an elongated shape in a right and left direction.

A supply unit 50 is supported by the frame 4 so as to be located above a rear end of the supply tray 30. The supply unit 50 includes a supply roller 60 that supplies (conveys) the recording medium stored in the supply tray 30 sheet by sheet to a conveyance path 5 provided at a rear end inside the body casing 2. The conveyance path 5 is formed such that the recording medium conveyed rearward from the supply tray 30 is turned upward and then is guided forward.

An image recording unit 70 that records (prints) an image on the recording medium, which is guided and conveyed by the conveyance path 5, is disposed above the supply unit 50. The recording medium after image recording thereon at the image recording unit 70 is discharged on a front portion of a top surface of the supply tray 30.

A detailed explanation of each component in the image forming apparatus 1 will now be provided.

[1-1. Structure of Supply Tray]

Figure 3:
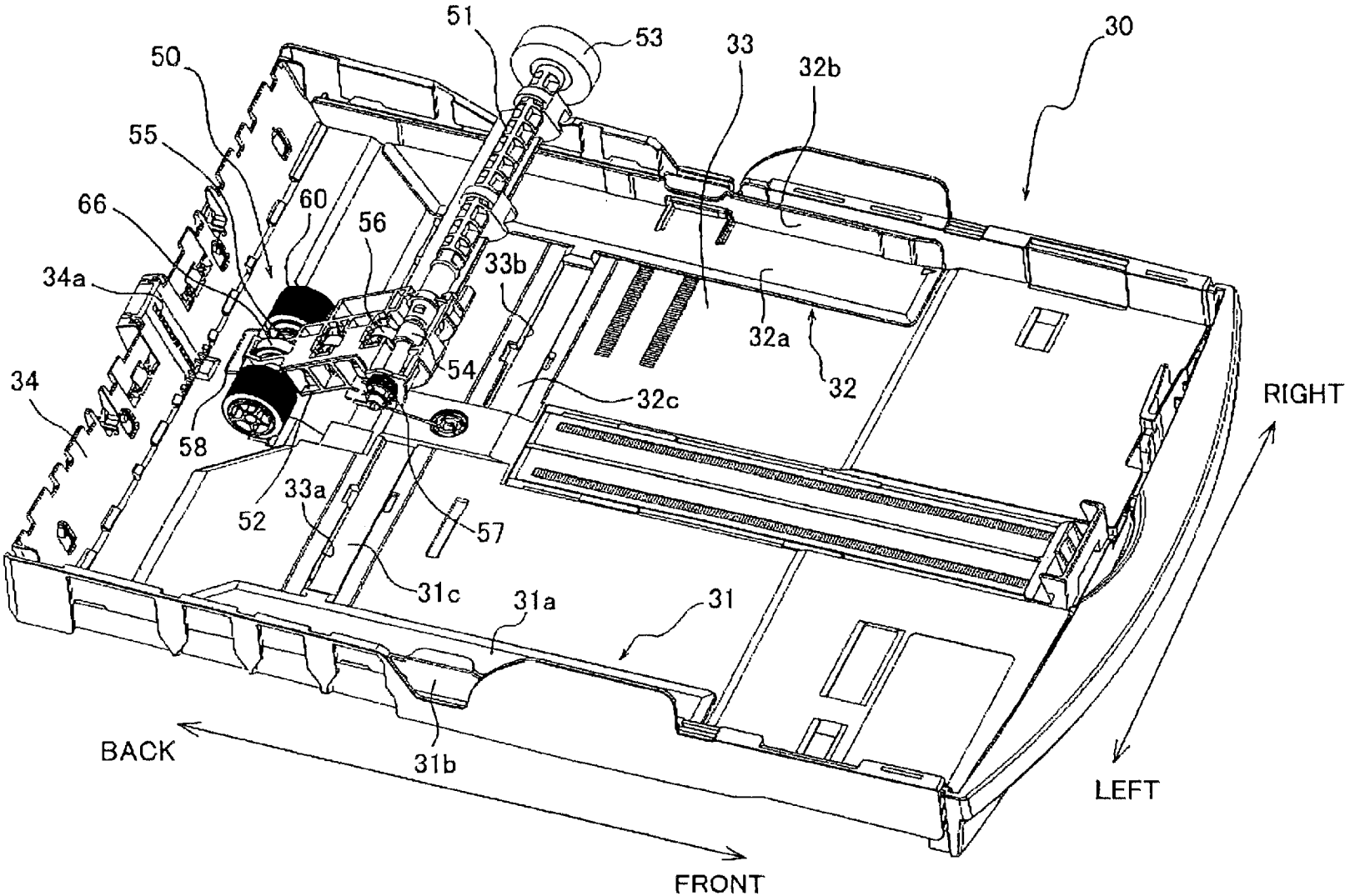
FIG. 3 is a diagrammatic perspective view of a supply tray and a supply unit without a second tray being disposed.
Figure 5:
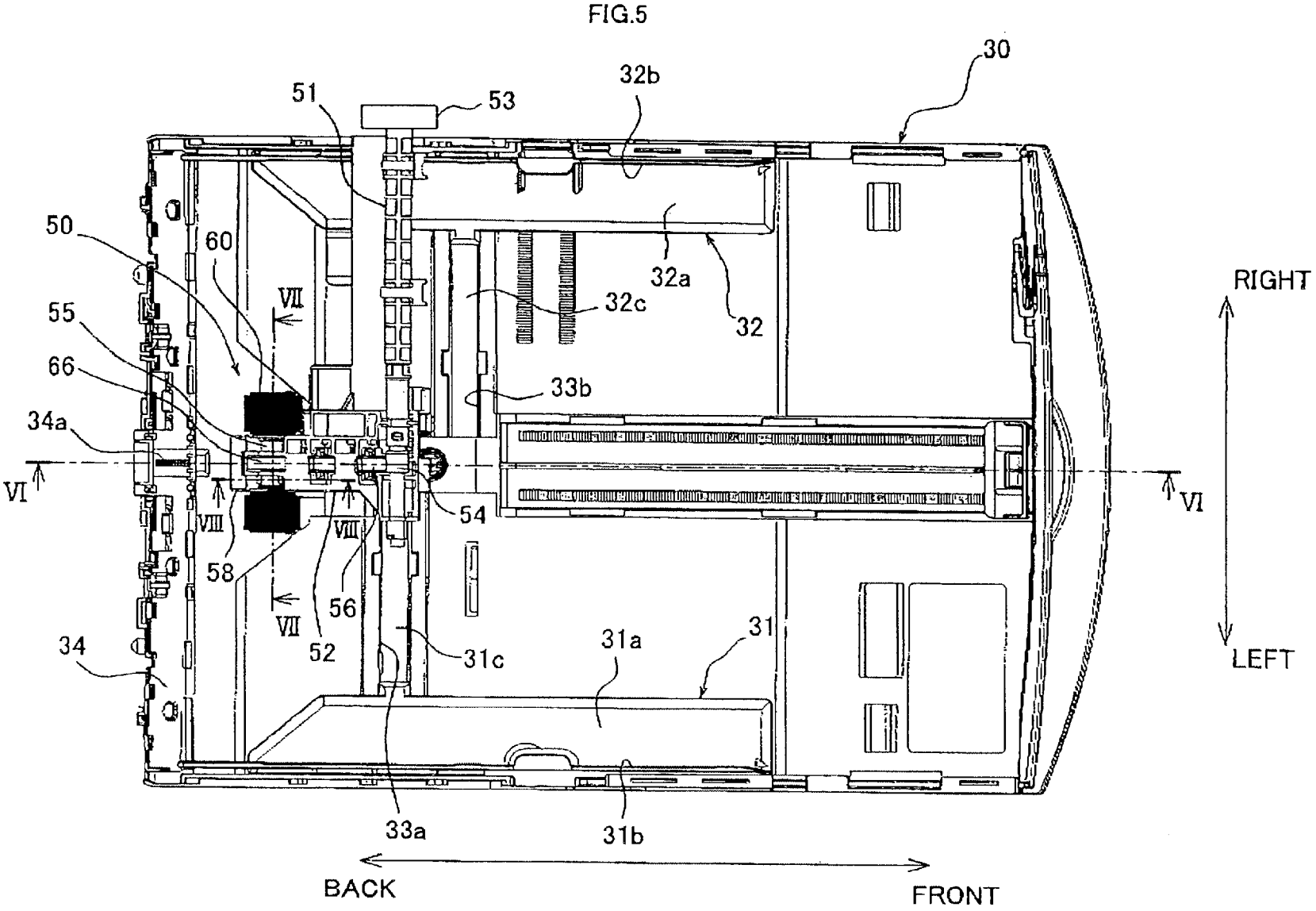
FIG. 5 is a plan view of the supply tray and the supply unit without the second tray being disposed.

As shown in FIGS. 3 and 5, the supply tray 30 can be a A4-sized, rectangular (when seen from above) thin dish-like component made of resin and is capable of storing the plurality of sheets of the recording medium in a stacked manner. The supply tray 30 is provided with a pair of side end guides 31, 32 in both sides. The side end guides 31, 32 allow the recording medium to be positioned such that a center line of the recording medium in the left and right direction (width direction) is at a fixed position, regardless of a size of the recording medium to be stored.

The side end guides 31, 32 include carrying plates 31*a*, 32*a* and side plates 31*b*, 32*b*, respectively. The recording medium is placed on upper surfaces of the carrying plates 31*a*, 32*a*. The side plates 31*b*, 32*b* are erected vertically upward from outside ends of the respective carrying plates 31*a*, 32*a* in the left to right direction.

A linear guide bar 31*c* extends from a bottom surface of the carrying plates 31*a* toward the side end guide 32, while a linear guide bar 32*c* extends from a bottom surface of the carrying plates 32*a* toward the side end guide 31. The linear guide bars 31*c*, 32*c* are disposed in parallel with and separate from each other by a predetermined distance in a front and back direction. The linear guide bars 31*c*, 32*c* are fitted in grooves 33*a*, 33*b*, which are disposed in a base plate 33 of the supply tray 30 along the left and right direction. The side end guides 31, 32 are displaceable in the left and right direction by sliding the linear guide bars 31*c*, 32*c* along the grooves 33*a*, 33*b*.

Rack gears are formed on opposite sides of the linear guide bars 31*c*, 32*c*. Each of the rack gears engages with a pinion gear rotatably disposed in a center of the base plate 33 in the width direction of the plate 33.

Both of the side end guides 31, 32 are connected to each other via the rack gears and the pinion gear and operated simultaneously so as to maintain a distance from each of the side plates 31*b*, 32*b* to the center line in the left and right direction of the supply tray 30 (so as to be symmetrical to each other). Consequently, the recording medium can be positioned such that the center line of the recording medium in the left and right direction is at a fixed position.

Portions of the side plates 31*b*, 32*b* to abut ends of the recording medium in the left and right direction have flat surfaces substantially parallel along the front and back direction (the direction to convey the recording medium). Thus, the recording medium positioned by the side end guides 31, 32 and stored in the supply tray 30 is prevented from being transported in the left and right direction (in a direction of a rotation axis of the supply roller 60). This can substantially reduce or prevent the recording medium from being skewed and allow the recording medium to be conveyed in a predetermined direction.

The supply tray 30 also includes a guide plate 34 in a rear end portion thereof and a metal separation member 34*a* disposed at a center of the guide plate 34 in the left and right direction. The separation member 34*a* has a plurality of tooth members arranged with a constant distance in an upper and lower direction, and a leading end of each tooth member is slightly protruded from a front surface of the guide plate 34. Consequently, the plurality sheets of the recording medium pushed out by the supply roller 60 of the supply unit 50 abut the leading ends of the tooth members, and an uppermost sheet of the recording medium is separated from the other sheets of the recording medium.

Figure 4:
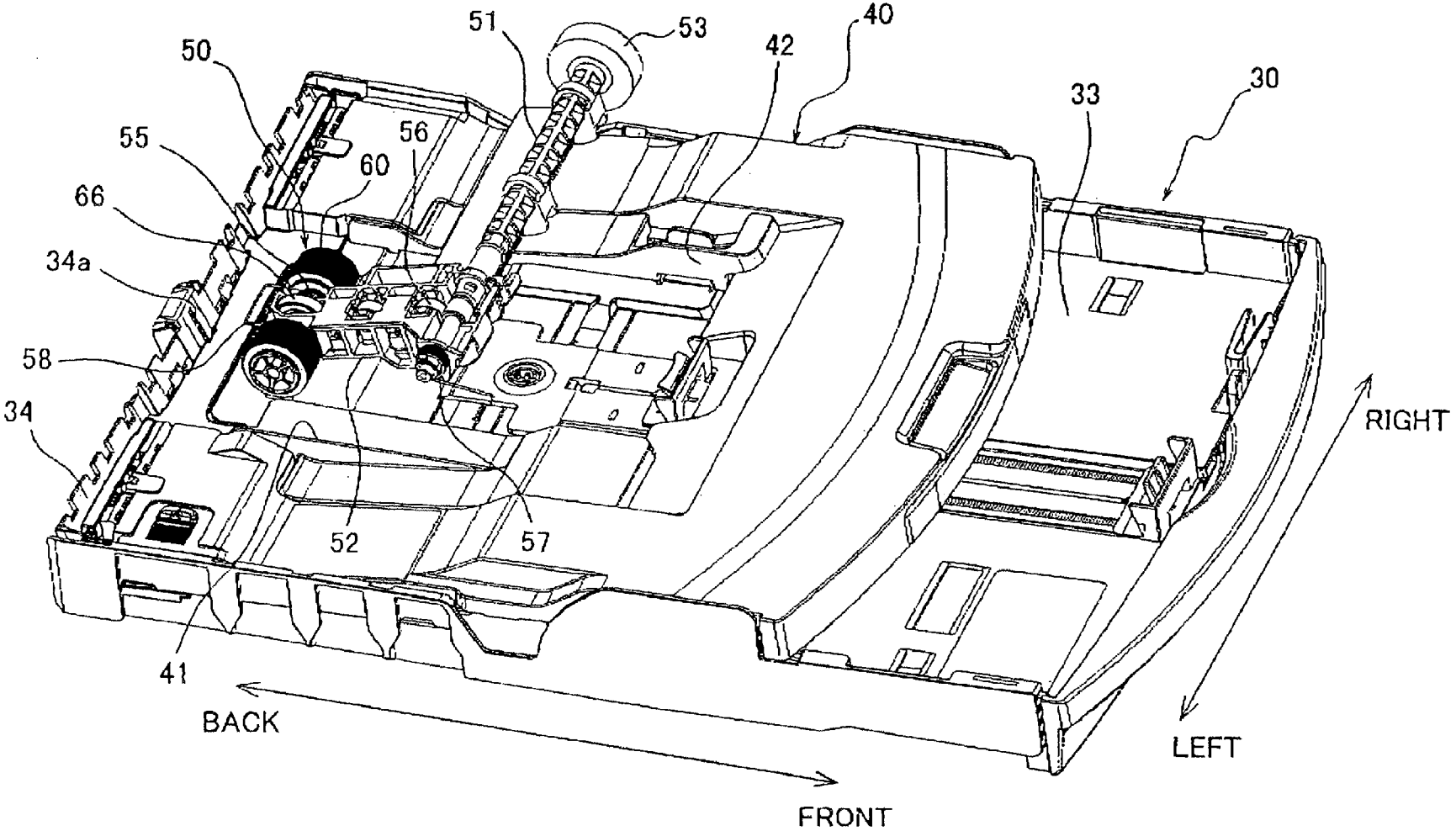
FIG. 4 is a diagrammatic perspective view of the supply tray and the supply unit with the second tray being disposed.

Moreover, as shown in FIG. 4, the supply tray 30 is configured to allow attachment and removal of a second tray 40 on the supply tray 30.

The second tray 40 is capable of storing a thick and small-sized recording medium such as a postcard or an envelope in a central portion in the left and right direction. The second tray 40 can be a rectangular, thin dish-like component, which is made of resin, and has substantially a same dimension in the left and right direction and a slightly shorter dimension in the front and back direction as compared with the supply tray 30. The second tray 40 is capable of storing the plurality of sheets of the recording medium in a substantially horizontally stacked manner.

Moreover, the second tray 40 is provided with a pair of side end guides 41, 42 that allow the recording medium to be positioned such that a center line of the recording medium in the left and right direction (width direction) is at a fixed position, regardless of a size of the recording medium to be stored, in a same manner as in the supply tray 30.

When the second tray 40 is placed at a predetermined position in a rear portion above the supply tray 30 (described in FIG. 4), the recording medium stored in the second tray 40 is disposed at a position so as to prevent the supply roller 60 from moving toward the supply tray 30 (downward). Therefore, the supply roller 60 of the supply unit 50 abuts not on the recording medium stored in the supply tray 30, but on the recording medium stored in the second tray 40, and thereby the recording medium stored in the second tray 40 can be moved to the conveyance path 5.

[1-2. Structure of Supply Unit]

A supply unit 50, as shown in FIGS. 3 to 5, 9 and 11, includes a support shaft 51 supported by the frame 4. The support shaft 51 is arranged along the left and right direction, over a range from a central portion to a right-side end of the supply tray 30 in the left and right direction. A big gear 53 is secured to a right-side end of the support shaft 51 whereas a small gear 54, which has substantially a same diameter as the support shaft 61, is secured near a left-side end of the support shaft 51.

Moreover, the supply unit 50 includes an arm member 52 supported by the support shaft 51. The arm member 52 is pivotable around the support shaft 51 with a distal end (a pivoting end) of the arm member 52 located in a rear lower position. A supply roller 60 is supported by the distal end of the arm member 52 so as to be rotated around a rotating shaft along a left and right direction. In other words, the arm member 52 is disposed so as to be pivoted around a pivot shaft (the support shaft 51), which is parallel to the rotating shaft of the supply roller 60 and is positioned above the recording medium stored in the supply tray 30 and on an opposite side of (upstream from) the rotating shaft of the supply roller 60 in the conveyance direction of the recording medium by the supply roller 60.

Figure 6A:
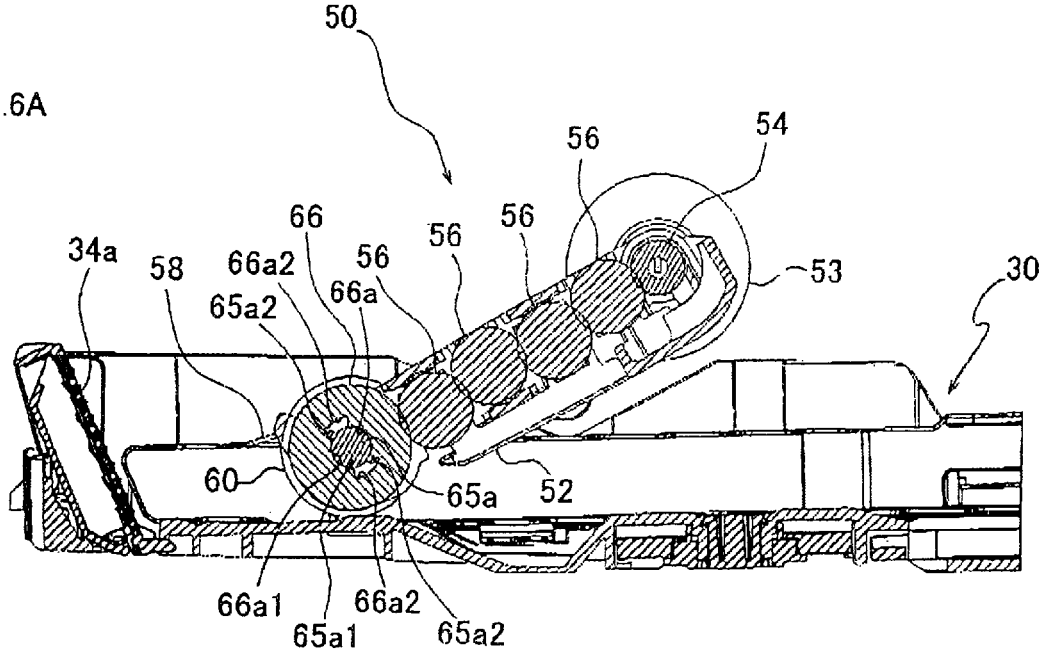
FIGS. 6A and 6B are cross-sectional views taken along line VI-VI of FIG. 5.
Figure 6B:
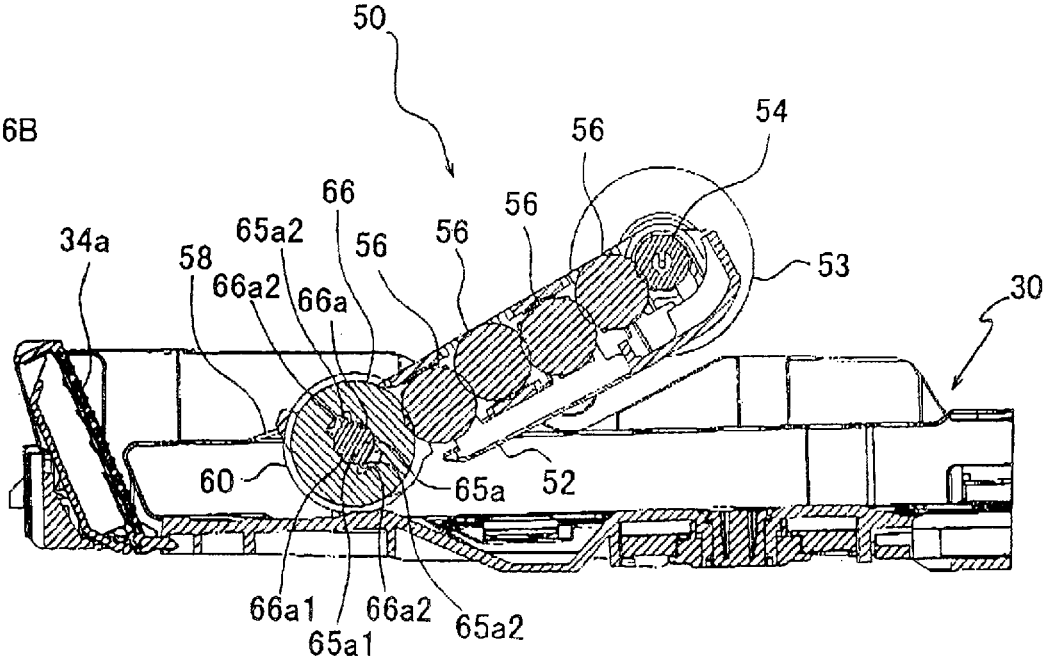
Figure 7A:
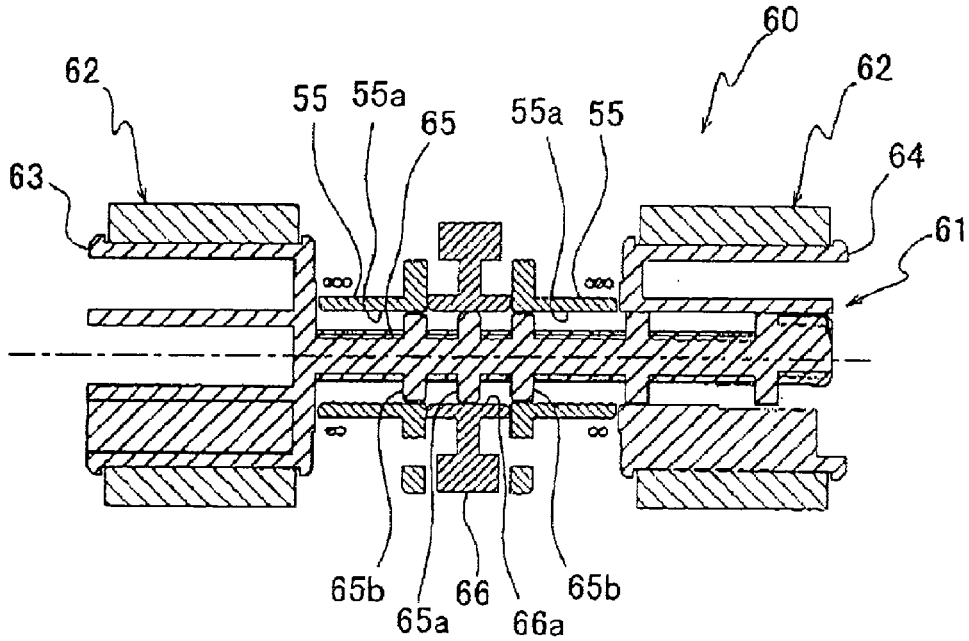
FIGS. 7A and 7B are cross-sectional views taken along line VII-VII of FIG. 5.
Figure 7B:
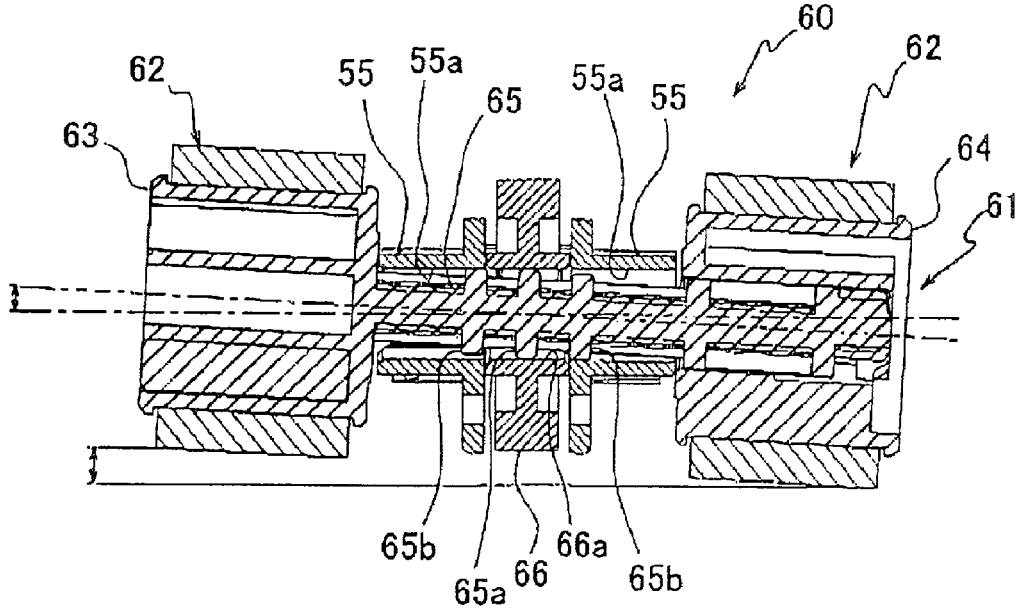

As shown in FIGS. 7A and 7B, the supply roller 60 is provided with a main body member 61, which can be made of resin, and two roller members 62, 62, which can be made of rubber, secured in the both side ends of the main body member 61. The main body member 61 includes cylinder roller support members 63, 64, in both left and right side ends of the main body member 61 in the rotating shaft direction. The roller members 62, 62 are secured to circumferences of the roller support members 63, 64, respectively. The main body member 61 also includes a rod-like shaft 65, which couples the cylinder roller support members 63, 64, in a central portion of the main body member 61 in the rotating shaft direction. The rod-like shaft 65 includes a gear abutment portion 65*a*, which is formed in a center of the shaft 65 ill the rotating shaft direction, and arm abutment portions 65*b*, 65*b*, which are formed at both sides of the gear abutment portion 65*a* in the rotating shaft direction. The shaft 65 has a cruciform cross section except in the gear abutment portion 65*a* and the arm abutment portions 65*b*, 65*b* (see FIG. 8). As shown in FIGS. 6A and 6B, a cross section in the gear abutment portion 65*a* is configured to include a circle 65*a*1 sized to include the cruciform cross section and a pair of protrusions 65*a*2, 65*a*2 positioned opposite to each other on a circumference of the circle 65*a*1. A cross section in each of the arm abutment portions 65*b*, 65*b* is configured to include a circle sized to include the cruciform cross section.

In the supply roller 60, the shaft 65 of the main body member 61 is axially supported at the distal end of the arm member 52. At the distal end of the arm member 52, two axial support members 55, 55 are disposed so as to sandwich a driving gear 66 which transmits a rotary driving force to the supply roller 60.

As shown in FIGS. 7A and 7B, each of the axial support members 55 includes a through-hole 55*a* having a circular cross section formed along the left and right direction. The supply roller 60 is rotatably supported with the shaft 65 of the main body member 61 inserted through the through-hole 55*a* of each axial support member 55. Each arm abutment portion 65*b* of the shaft 65 is positioned opposedly to a center side end of the each axial support member 55 of the arm member 52 in the left and right direction of the through-hole 55*a*.

In other words, a clearance between the shaft 65 and the through-hole 55*a* is narrowest in a center side portion of a rotating shaft direction of the shaft 65, and the supply roller 60 is axially supported by the distal end of the arm member 52 in the center side portion of the rotating shaft direction.

The above described configuration can reduce a degree of positional freedom of the shaft 65 in the center portion (i.e., jolt of the driving gear 66) in the left and right direction of the shaft 65 to effectively transmit the rotary driving force from an LF motor 6 to the shaft 65, while allowing a large degree of positional freedom of the shaft 65 in both side-ends (the degree of freedom in an angle of the rotating shaft) in the left and right direction of the shaft 65. Thus, the arm member 52 supports the supply roller 60 with a certain degree of freedom in the angle of the rotating shaft (the angle between a standard state of the shaft 65 as shown in FIG. 7A and a maximum tilting state of the shaft 65 as shown in FIG. 7B such as 3 degrees).

In the supply roller 60, the shaft 65 of the main body member 61 is also inserted through the through-hole 66*a* formed in the driving gear 66. The through-hole 66*a*, as shown in FIGS. 6A and 6B, has a cross-sectional configuration including a circle 66*a*1 corresponding to a size of the circle 65*a*1 of the gear abutment member 65*a* of the shaft 65 and a pair of sector cutouts 66*a*2 formed opposedly each other on the circumference of the circle 66*a*1. A circumferential length of each of the sector cutouts 66*a*2 of the through-hole 66*a* is larger than a circumferential length of each of the protrusions 65*a*2 of the gear abutment member 65*a*. Thus, the supply roller 60 has a certain amount (e.g., 60 degrees) of play in the rotating direction against the driving gear 66.

Figure 8:
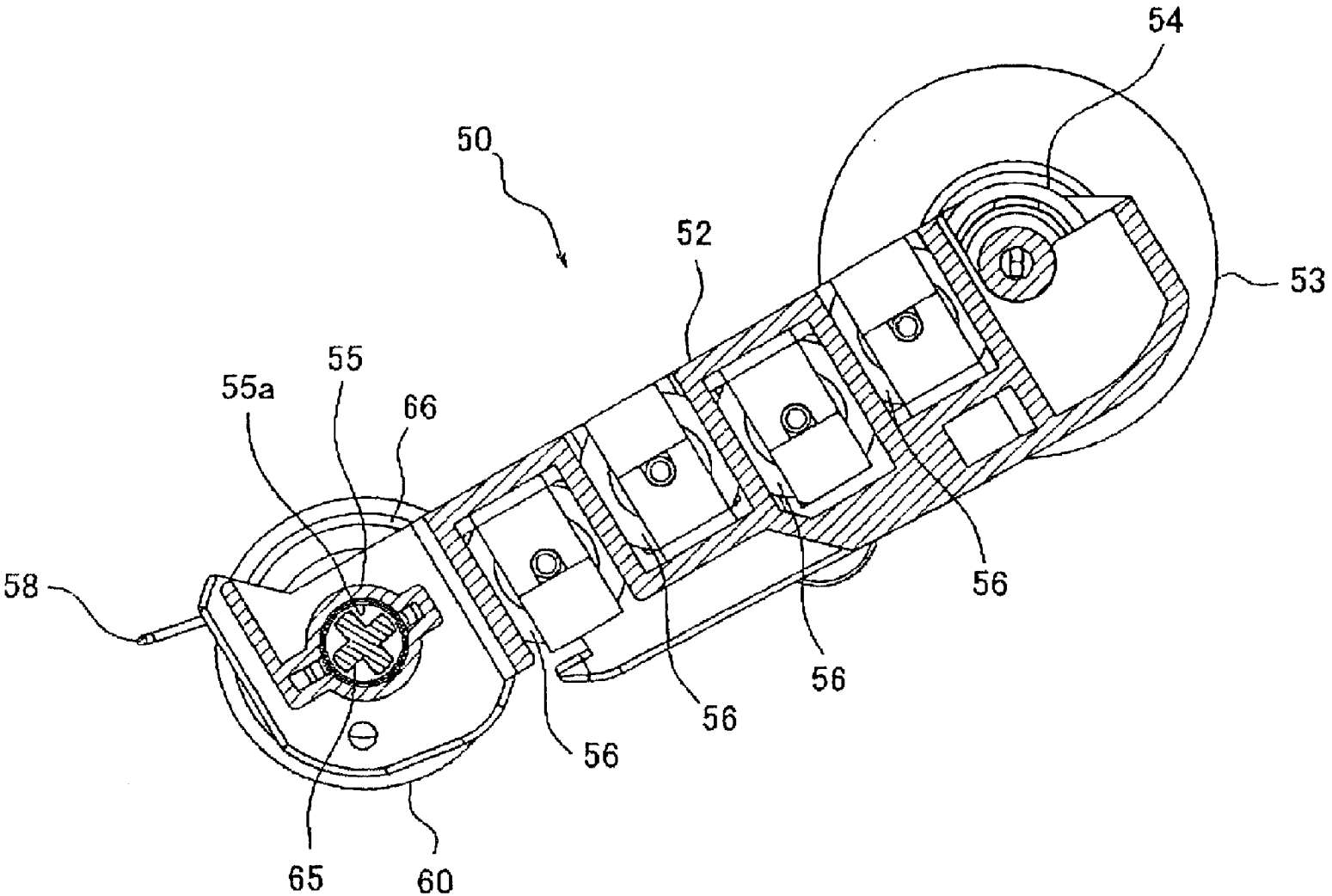
FIG. 8 is a cross-sectional view along line VIII-VIII of FIG. 5.

In the arm member 52, as shown in FIGS. 6A, 6B and 8, four power transmission gears 56, 56, 56, 56 are aligned along an extending direction of the arm member 52. The power transmission gears 56, 56, 56, 56 connect the small gear 54 secured to the support shaft 51 and the driving gear 66, through which the shaft 65 of the main body member 61 of the supply roller 60 is inserted.

Figure 10A:
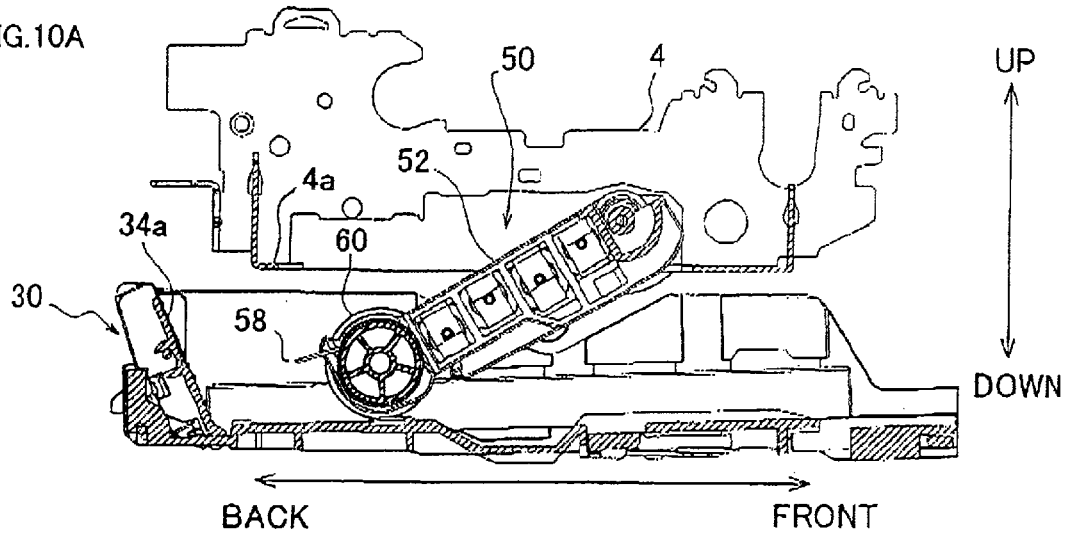
FIGS. 10A, 10B and 10C are cross-sectional views taken along line X-X of FIG. 9.

The arm member 52 is pivotable around the support shaft 51 from a downward tilt position, in which the rotating shaft of the supply roller 60 is lower than the support shaft 51, to a horizontal position, in which the rotating shaft of the supply roller 60 is substantially as high as a center of the support shaft 51. As shown in FIG. 3, a first twist spring 57 is provided to a proximal end (a pivot shaft side) of the arm member 52. The first twist spring 57 is designed to apply a downward bias force (i.e., a bias force in a direction to force the supply roller 60 to abut the recording medium stored in the supply tray 30) to the arm member 52 in an entire pivotable area of the arm member 52. Thus, the supply roller 60 abuts an uppermost sheet of the recording medium stored in the supply tray 30 (see FIG. 10A).

Moreover, a second twist spring 58 is provided to the distal end of the arm member 52, as shown in FIGS. 3 and 5. The second twist spring 58 is designed to apply a downward bias force (i.e., a bias force in a direction to increase the bias force of the first twist spring 57) to the arm member 52 only when the arm member 52 is raised close to the horizontal position (in other words, an angle between a surface including the rotating shaft and the pivot shaft of the supply roller 60 and a surface of the recording medium is smaller than a predetermined angle). When the second twist spring 58 abuts an abutment piece 4*a* (a part of the frame 4), which is disposed within a path of pivot movement of the arm member 52 around the pivot shaft, the second twist spring 58 is elastically deformed thereby to apply the bias force to the arm member 52.

Figure 10B:
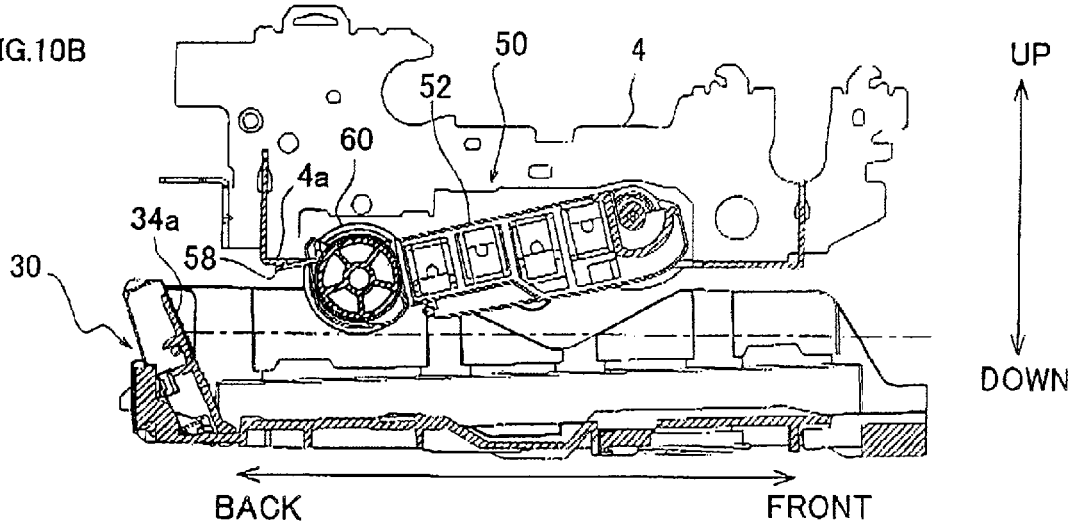
Figure 10C:
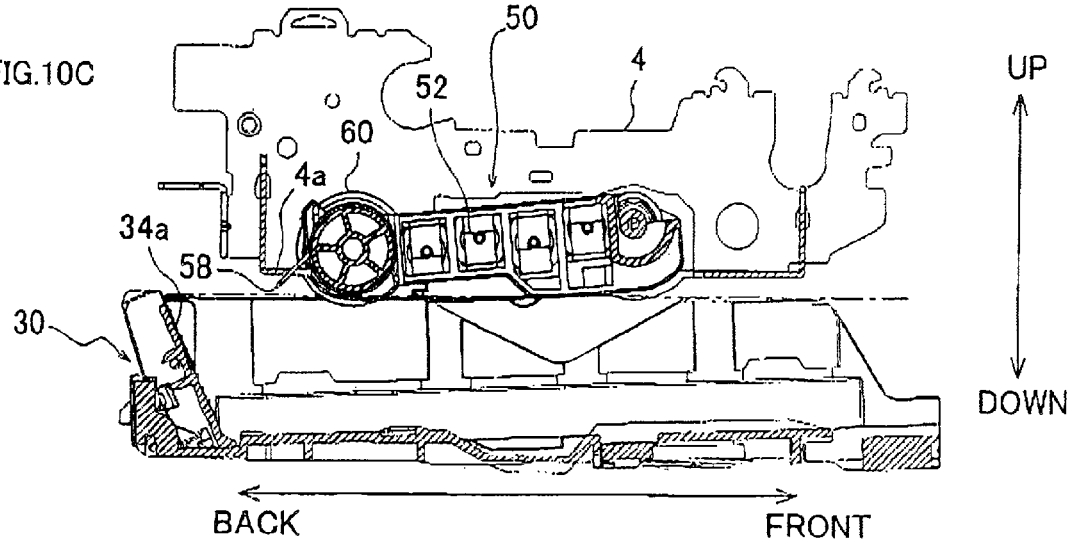
Figure 11:
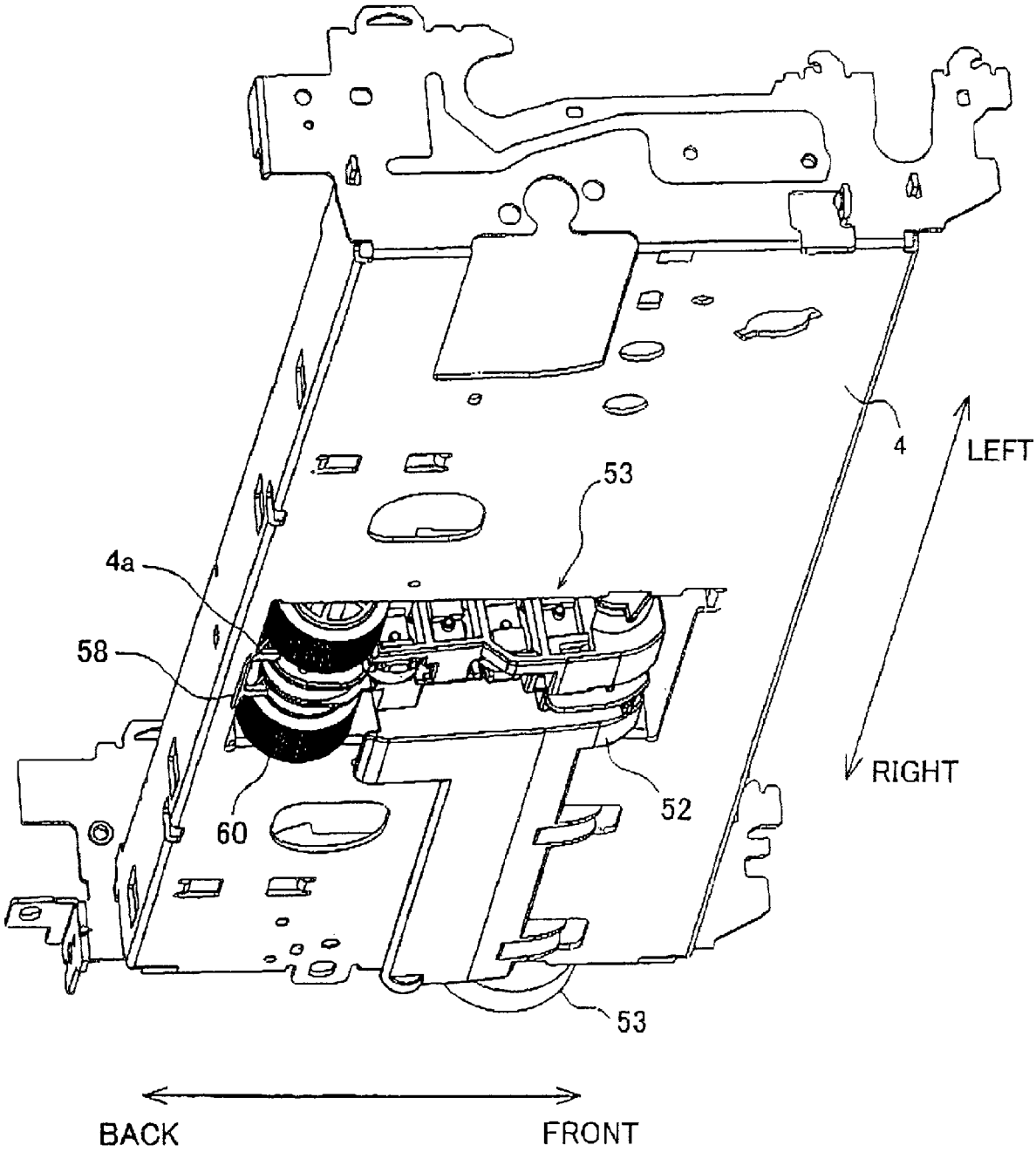
FIG. 11 is a diagrammatic perspective view in a state of FIG. 10C seen from below the frame.

Specifically, a free end of the second twist spring 68 abuts the abutment piece 4*a* formed in the frame 4 to apply a downward bias force to the arm member 52, when the arm member 52 is arranged so that the supply roller 60 abuts the recording medium stored in the second tray 40 (see FIGS. 10B, 10C and FIG. 11). The dashed dotted line in FIG. 10B represents a position of a bottom surface of the second tray 40 (in other words, a vertical position of the recording medium when only a sheet of the recording medium is stored in the second tray 40). The dashed dotted line in FIG. 10C represents a position of an uppermost sheet of the recording medium when the recording medium is fully loaded in the second tray 40.

[1-3. Structure of Image Recording Unit]

Next, an exemplary structure of an image recording unit 70 will be described.

Figure 12:
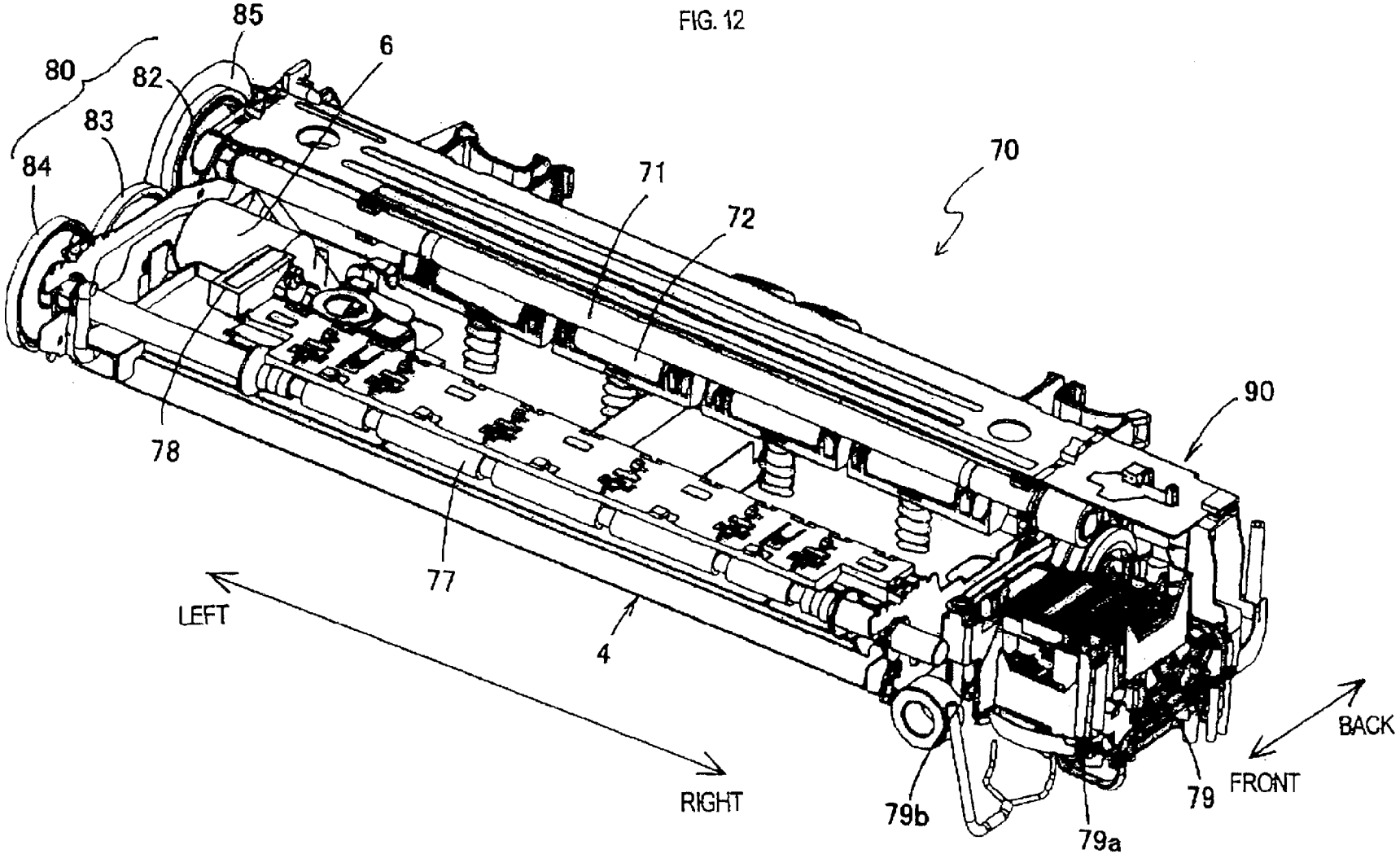
FIG. 12 is a diagrammatic perspective view of an image recording unit.
Figure 13:
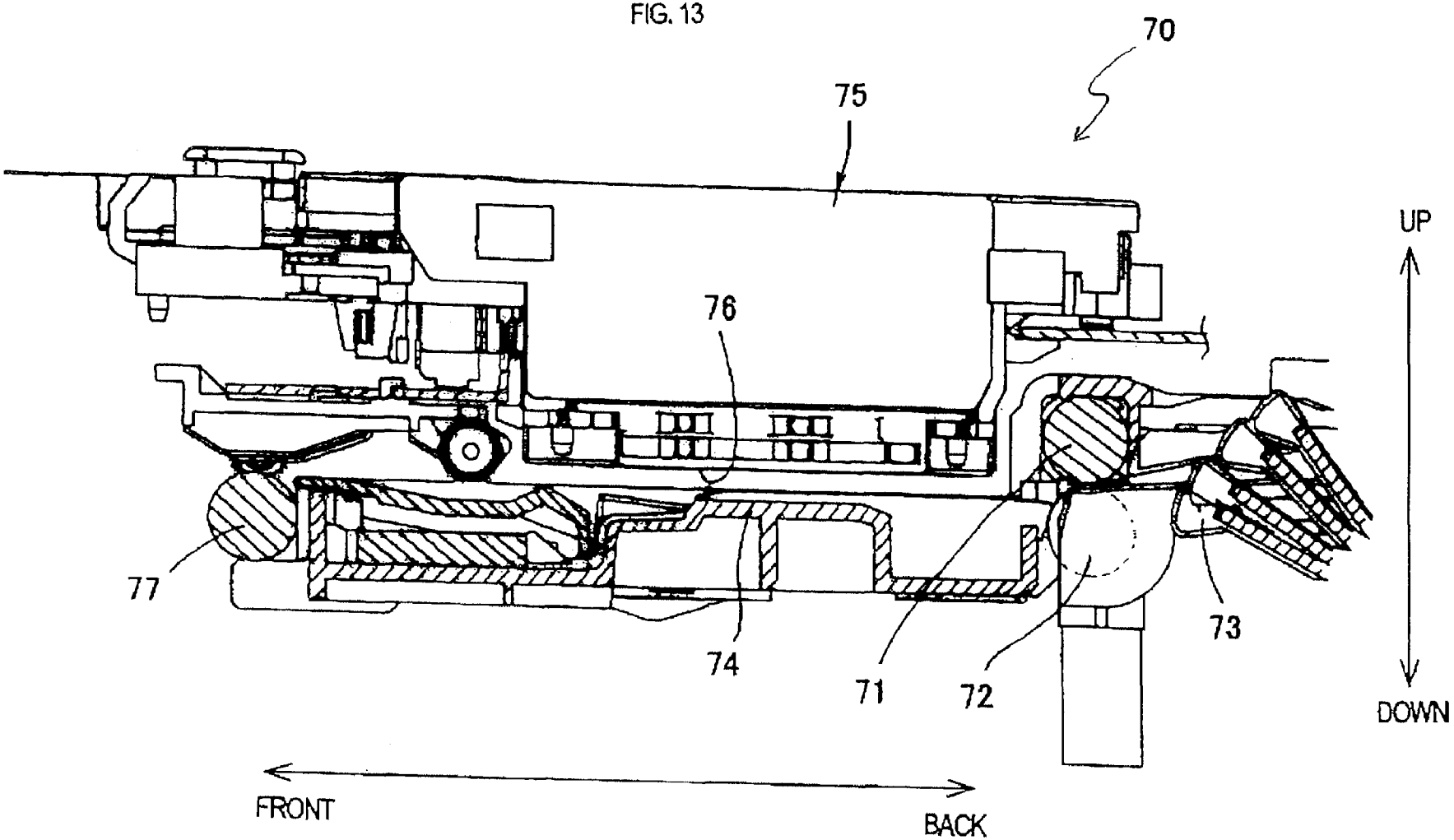
FIG. 13 is a schematic cross-sectional side view of the image recording unit.

As shown in FIGS. 2, 12 and 13, the image recording unit 70 is provided with a conveyance roller 71 at a position where the recording medium is conveyed in a U-turn manner from the supply tray 30 in the conveyance path 5. The conveyance roller 71 is supported by side plates of the frame 4 so as to be rotatable around a rotating shaft along the left and right direction.

The image recording unit 70 is also provided with a driven roller 72 which is rotatable around a rotating shaft parallel with the rotating shaft of the conveyance roller 71 and is rotated following the conveyance roller 71. That is, the conveyance roller 71 and the driven roller 72 are formed as a set of rollers.

Moreover, a regist sensor 73 is disposed on a rear side of the conveyance roller 71 (an upstream side of the conveyance path of the recording medium) (see FIG. 13). The regist sensor 73 can detect a leading end position and a rear end position of the recording medium conveyed from the supply tray 30.

The image recording unit 70 further includes a platen 74 and a carriage 75 on a frond side of the driven roller 72 (a downstream side of the conveyance path of the recording medium). The platen 74 supports the recording medium from thereunder, and the carriage 75 is movable along the left and right direction (a main scanning direction) above the platen 74. A recording head 76, which can discharge inks of a plurality of colors to record a color image, is mounted on the carriage 75.

An image is recorded when the inks are discharged from the recording head 76 toward the recording medium on the platen 74 while the carriage 75 is moved along the main scanning direction.

The image recording unit 70 further includes a discharge roller 77 on the front-side of the platen 74 (on a downstream side of the conveyance path of the recording medium). The discharge roller 77 is supported by the side plates of the frame 4 so as to be rotatable around a rotating shaft along the left and right direction.

As shown in FIG. 12, the image recording unit 70 is provided with an ink receiver 78 on a left side and a maintenance unit 79 in a right side outside a width of the recording medium to be conveyed. The recording head 76 periodically discharges ink at a flashing position disposed in the ink receiver 78 during recording operation to inhibit nozzle clogging.

2. Explanation of Driving Mechanism

Next, an exemplary driving mechanism of the image forming apparatus 1 of the present embodiment will be discussed.

Figure 14:
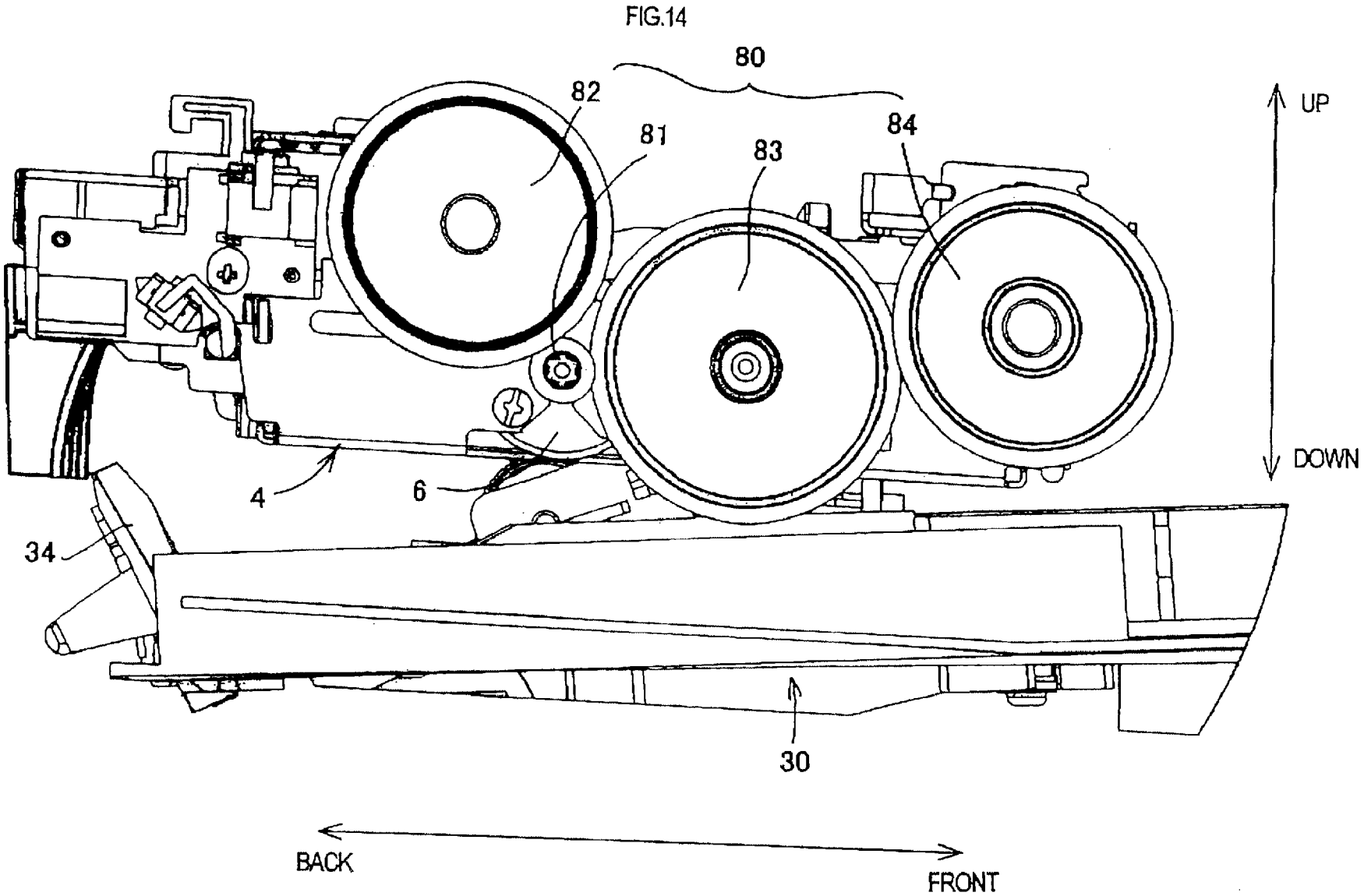
FIG. 14 is a diagrammatic side view of the image recording unit.

As shown in FIGS. 12 and 14, the image forming apparatus 1 is provided with an LF motor 6 which can generate a rotary driving force in a forward direction and a reverse direction. The rotary driving force generated by the LF motor 6 is transmitted to the conveyance roller 71 and the discharge roller 77 via a gear driving mechanism 80.

Specifically, the gear driving mechanism 80 includes a pinion 81, a transmission gear 82, an intermediate gear 83 and a transmission gear 84. The pinion 81 is positioned in a driving shaft of the LF motor 6. The transmission gear 82 and the intermediate gear 83 engage with the pinion 81 from both sides of the pinion 81. The transmission gear 84 engages with the intermediate gear 83. The transmission gear 82 is secured to a left end of the conveyance roller 71. The transmission gear 84 is secured to a left end of the discharge roller 77. A rotary encoder 86 that detects a conveyance amount of a recording medium is disposed in a part of the gear driving mechanism 80.

Figure 15:
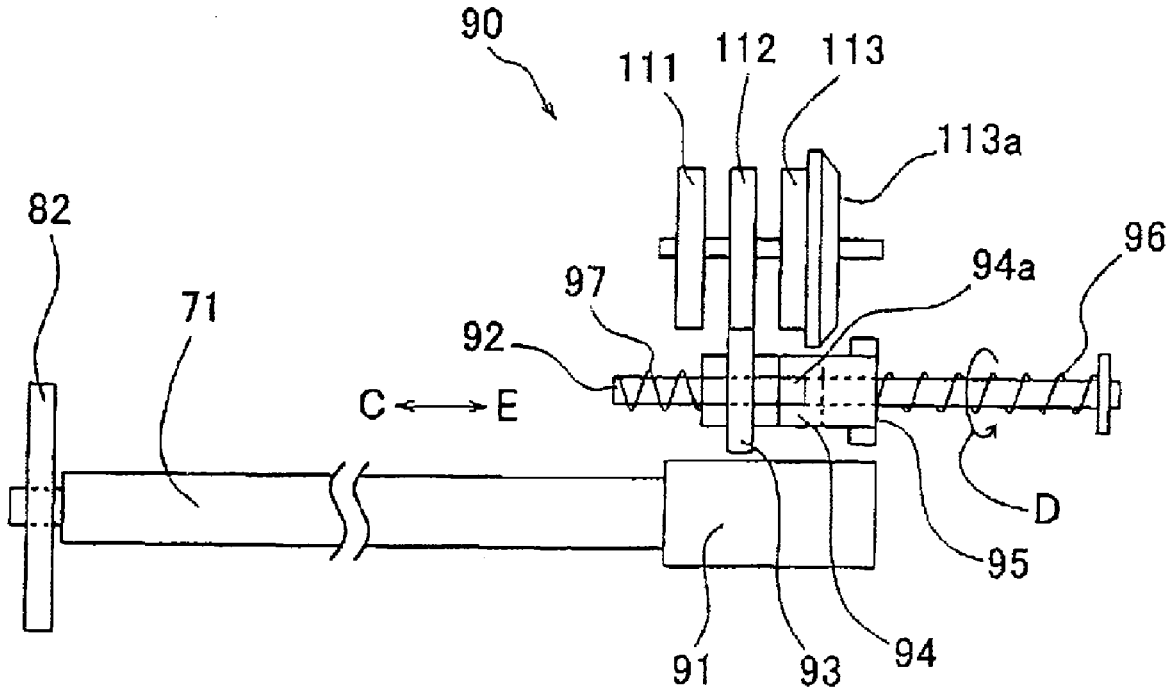
FIG. 15 is a schematic plan view of a power transmission switching mechanism.

As shown in FIG. 15, the rotary driving force generated by the LF motor 6 is transmitted from a right end of the conveyance roller 71 to the supply roller 60 of the supply unit 50 or a maintenance mechanism (details are not shown) of the maintenance unit 79 through a power transmission switching mechanism 90 which is disposed above the maintenance unit 79.

The power transmission switching mechanism 90 switches a transmission state of the rotary driving force transmitted from the LF motor 6 via the conveyance roller 71 between a maintenance mode and a conveyance mode. In the maintenance mode, the rotary driving force is transmitted only to the maintenance unit 79. In the conveyance mode, the rotary driving force is transmitted only to the supply roller 60 of the supply unit 50.

In the conveyance mode, the transmission state can be switched between an intermittent supply mode and a consecutive supply mode. In the intermittent supply mode, while one of the conveyance roller 71 and the supply roller 60 is rotated in a forward direction, the rotary driving force is transmitted so that the other roller is rotated in a reverse direction. In the consecutive supply mode, on the other hand, the rotary driving force is transmitted so that both the conveyance roller 71 and the supply roller 60 are rotated in the forward direction.

The image forming apparatus 1 is designed such that a conveyance speed of the recording medium by the conveyance roller 71 is faster than a conveyance speed of the recording medium by the supply roller 60. The forward direction for each of the rollers 60, 71 and 77 is a rotating direction to convey the recording medium from a supply side to a discharge side. Specifically, the forward directions for the supply roller 60 and the conveyance roller 71 are the rotating directions to convey the recording medium to an image forming position by the image recording unit 70. The forward direction for the discharge roller 77 is the rotating direction to convey the recording medium from the image forming position by the image recording unit 70 to a discharge position.

Now, a specific structure of a power transmission switching mechanism 90 will be discussed.

As shown in FIG. 15, the power transmission switching mechanism 90 is provided with a drive gear 91 and a switching gear 93. The drive gear 91 elongated in a shaft direction of the conveyance roller 71 is secured in the right end of the conveyance roller 71. The switching gear 93 is disposed slidably against a slide shaft 92 arranged in parallel with the rotating shaft of the conveyance roller 71 and constantly engages with the driving gear 91.

The power transmission switching mechanism 90 is provided with a first block 94 and a second block 95. The first block 94 having an upwardly extending abutment piece 94*a* is disposed slidably against and rotatably around the slide shaft 92. The second block 95 is disposed slidably against the slide shaft 92 and adjacent to the first block 94. The first block 94 is disengageable from the switching gear 93.

The power transmission switching mechanism 90 is provided with a first bias spring 96 and a second bias spring 97. The first bias spring 96 is fitted around the slide shaft 92 and applies a bias force to the second block 95 in an arrow C direction in FIG. 15. The second bias spring 97 is fitted around the slide shaft 92 and applies a bias force to the switching gear 93 in an arrow E direction in FIG. 15.

In addition, the power transmission switching mechanism 90 is provided with an intermittent supply transmission gear 111, a consecutive supply transmission gear 112 and a maintenance transmission gear 113. Each of these transmission gears 111, 112 and 113 may engage with the switching gear 93 depending on a sliding position of the switching gear 93.

The abutment piece 94*a* of the first block 94 is positioned to abut either a first engagement shoulder 75*a* or a second engagement shoulder 75*b* (see FIG. 16A) provided to the carriage 75. Therefore, the switching gear 93, the first block 94 and the second block 95 can be moved along the slide shaft 92 in either the arrow C direction or the arrow E direction in accordance with a movement of the carriage 75 in the arrow C direction or the arrow E direction. In a position where the first block 94 and the second block 95 face each other, an end cam portion (not shown) tilted against the rotating shaft of the slide shaft 92 is provided. The end cam portion is designed such that the abutment piece 94*a* is rotated in an arrow D direction in FIG. 15 when the first block 94 is pushed by the second block 95 in the arrow C direction.

Figure 16A:
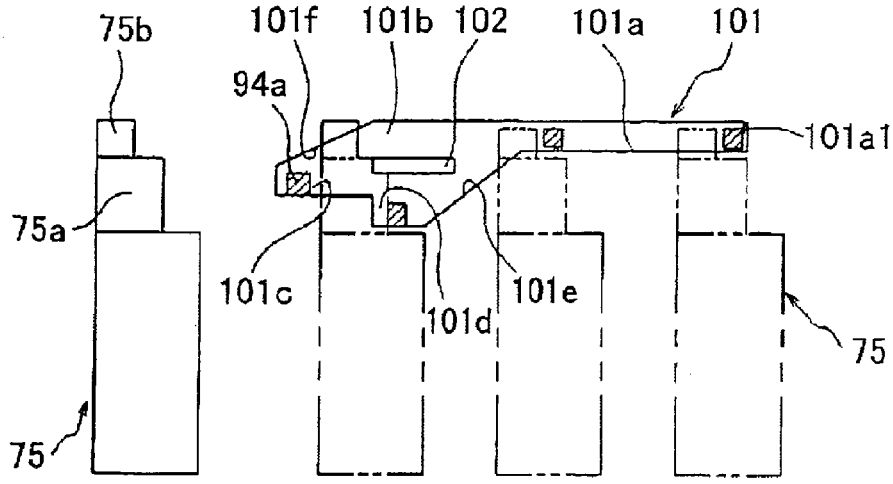
FIG. 16A is a schematic plan view of a guide block in the power transmission switching mechanism.
Figure 16B:
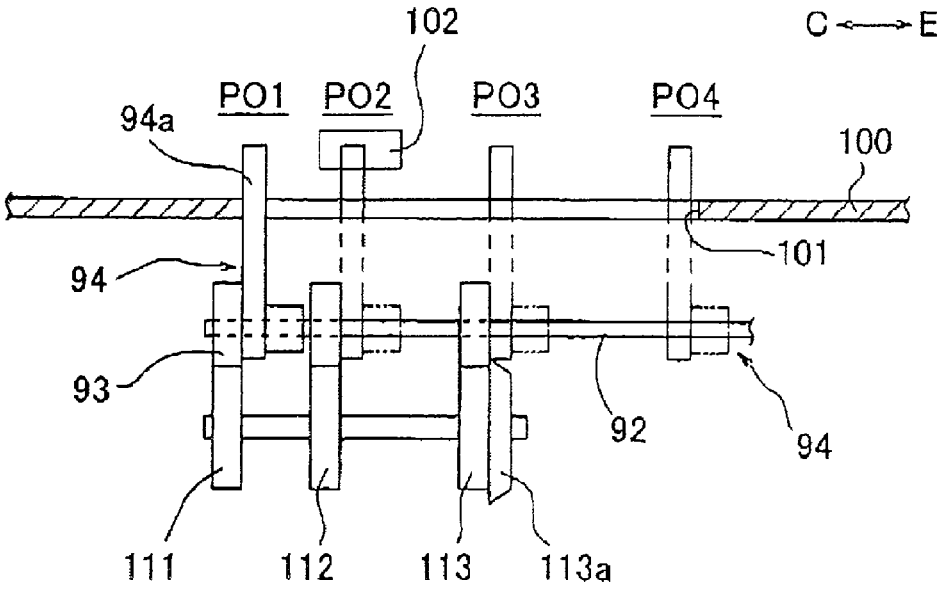
FIG. 16B is schematic front view of the power transmission switching mechanism.

As shown in FIGS. 16A and 16B, a plate-like guide block 100 is disposed above the first block 94. The guide block 100 includes a guide groove 101 in which an end portion of the abutment piece 94*a* is slidable while passing through the guide groove 101 in an upward and downward direction.

As shown in the plan view of FIG. 16A, the guide groove 101 includes a linear groove portion 101*a* extending in the arrow C and E directions and a clockwise circular groove portion 101*b* which communicates with a left end of the linear groove portion 101*a*. A restriction piece 102, which extends in a downward direction from above the guide block 100, is provided in a central portion of the circular groove portion 101*b*. The restriction piece 102 is formed along the linear groove portion 101*a*. Moreover, a first set portion 101*c* and second set portion 110*d* are formed in one side of the circular groove portion 101*b*.

Therefore, as shown in FIG. 16A, when the carriage 76 is largely moved from the maintenance unit 79 in the arrow C direction and in a recording region for the recording medium, the first block 94 and the switching gear 93 are moved along the slide shaft 92 through the second block 95 being pushed by the first bias spring 96 in the arrow C direction. Then, the abutment piece 94*a* of the first block 94 is located at a position in the first set portion 101*c* (hereafter, this position will be referred to as "the first position (PO1)"). At the first position (PO1), the switching gear 93 engages with the intermittent supply transmission gear 111.

When the carriage 75 is moved from the first position (PO1) in the arrow E direction at the maintenance unit 79, the abutment piece 94*a* of the first block 94 is pushed by the first engagement shoulder 75*a* of the carriage 75 to a position in the second set portion 101*d* (hereafter, this position will referred to as "the second position (PO2)"). At the second position (PO2), the switching gear 93 engages with the consecutive supply transmission gear 112.

When the carriage 75 is moved from the second position (PO2) in the arrow E direction, the abutment piece 94*a* of the first block 94 is pushed by the first engagement shoulder 75*a* of the carriage 75 along an oblique connecting surface 101*e* connecting the circular groove portion 101*b* to the linear groove portion 101*a*. When the abutment piece 94*a* is located at a position at an entrance of the linear groove portion 101*a* (hereafter, this position will be referred to as "the third position (PO3)"), the switching gear 93 engages with the maintenance transmission gear 113. In this state, the abutment piece 94*a* abuts the second engagement shoulder 75*b*.

When the carriage 76 is moved from the third position (PO3) further in the arrow E direction, the abutment piece 94*a* of the first block 94 is pushed by the second engagement shoulder 75*b* of the carriage 75 to a position at a rear end 101*a*1 (i.e., a right end in FIG. 16A) of the linear groove portion 101*a* (hereafter, this position will be referred to as "the fourth position (PO4)"). The fourth position (PO4) is usually a home position (an original position). In this state, a side surface of the switching gear 93 abuts a bevel gear portion 113*a* of the maintenance transmission gear 113 and thereby movement of the switching gear 93 in the arrow E direction is prevented. As a result, the switching gear 93 is detached from the first block 94, and remains in an engaged state with the maintenance transmission gear 113.

In contrast to an operation described above, when the carriage 75 is moved from the fourth position (PO4) in the arrow C direction, the abutment piece 94*a* is moved from the linear groove portion 101*a* to the circular groove portion 101*b*. In this case, the abutment piece 94*a* is received by the first engagement shoulder 75*a*, and thus is not led to the above-mentioned oblique connecting surface 101*e*. Therefore, the abutment piece 94*a* slidably contacts with the restriction piece 102 and led to a left end of the circular groove portion 101*b* along a left oblique surface 101*f* of the circular groove portion 101*b*, as shown in FIG. 16A. Then, the abutment piece 94*a* engages with the first set portion 101*c*.

Among the four positions explained above, the third position (PO3) is a maintenance position which is also used as a waiting position. At this position, a cap portion 79*a* of the maintenance unit 79 covers a nozzle surface of the recording head 76 from underneath (see FIG. 12). During maintenance operation, the LF motor 6 may be driven to selectively suctioning ink from a nozzle by actuating a suction pump (not shown). A recovery process of removing air bubbles from a buffer tank (not shown) disposed above the recording head 76 may also be performed.

When the carriage 75 is moved in the left direction from the maintenance unit 79 toward the image forming region, the nozzle surface is wiped with a cleaner (a wiper blade) 79*b*. Consequently, ink attached to the nozzle surface may be removed. When the image forming apparatus 1 is not on, the carriage 75 is stopped right above the maintenance unit 79 (at the third position (PO3)) and the nozzle surface of the recording head 76 is covered with the cap 79*a* above the maintenance unit 79 in a close contact manner.

Figure 17A:
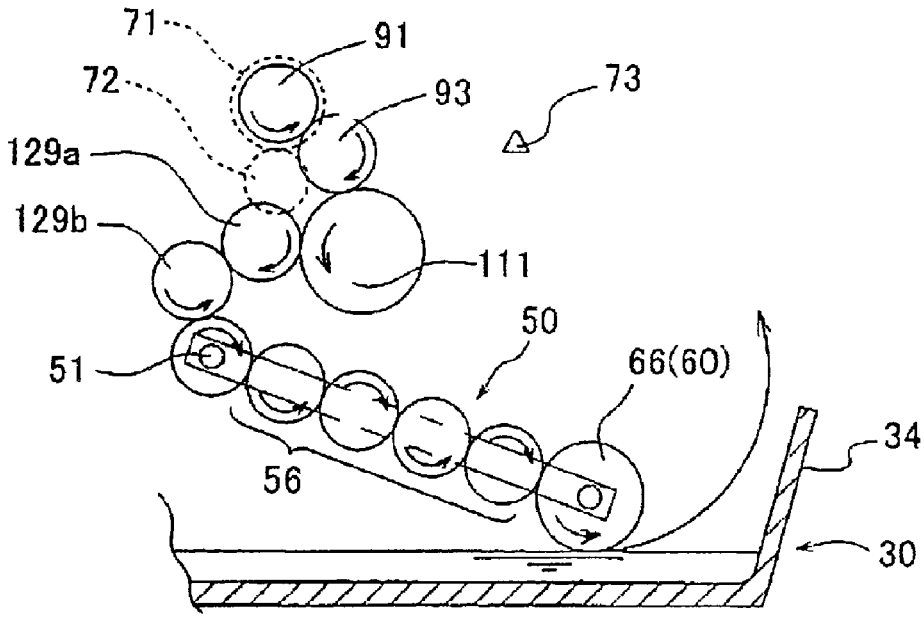
FIGS. 17A and 17B are schematic views explaining a rotary driving force transmission path in an intermittent supply mode.
Figure 17B:
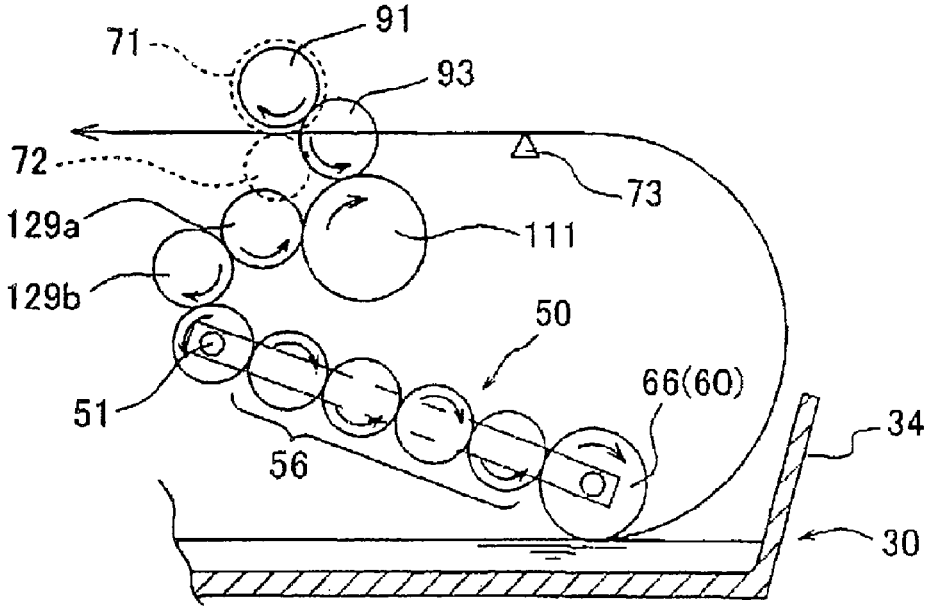
Figure 19A:
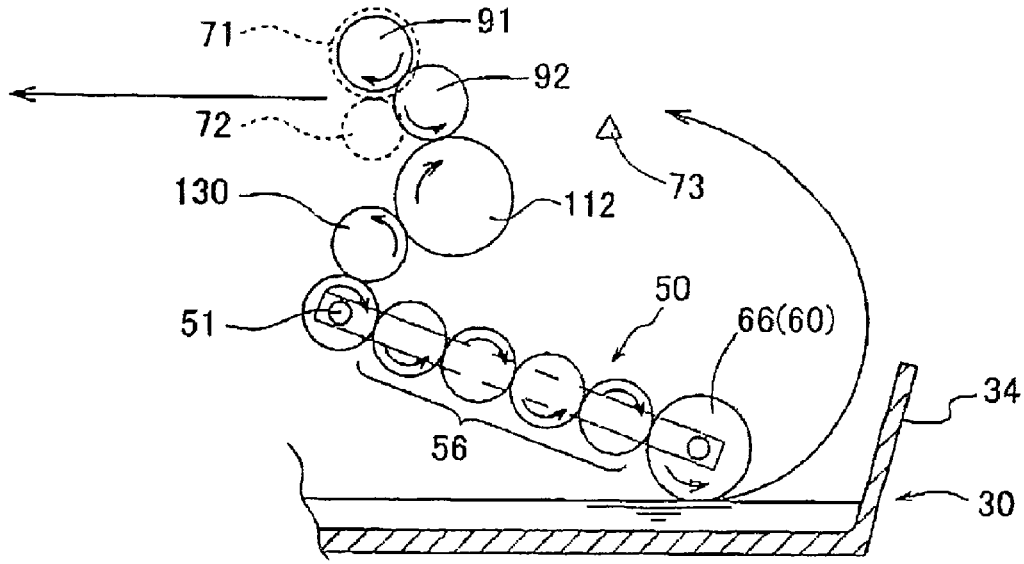
FIGS. 19A and 19B are schematic views explaining a rotary driving force transmission path in a subsequent medium processing process.
Figure 19B:
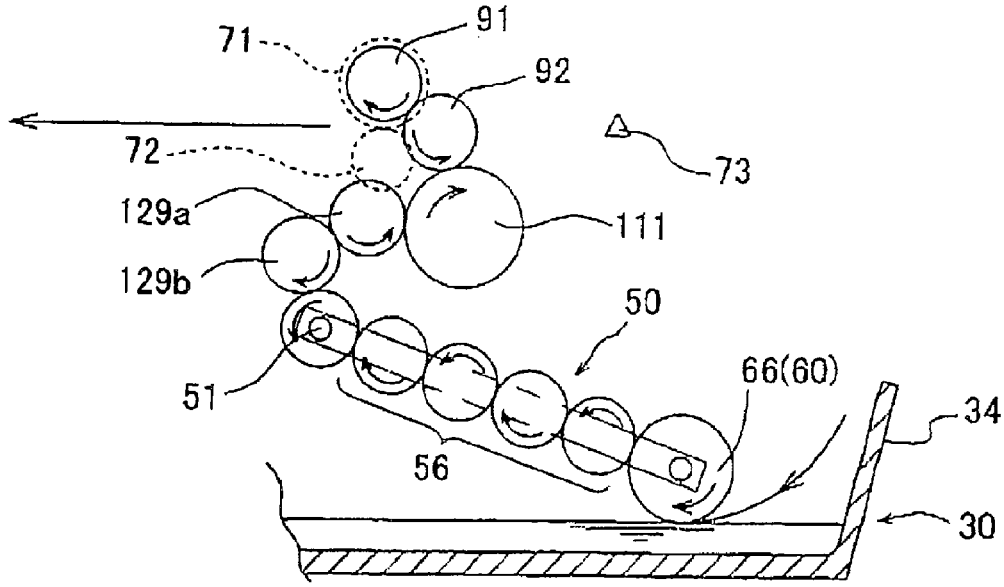

When the switching gear 93 is at the first position (PO1) where the switching gear 93 engages with the intermittent supply transmission gear 111, power is transmitted to the support shaft 51, which is provided at the proximal end of the arm member 52, through two intermediate gears 129*a*, 129*b*, as shown in FIGS. 17A, 17B and 19B. Then, the rotary driving force is transmitted to the driving gear 66 through the power transmission gears 66.

When the switching gear 93 is at the second position (PO2) where the switching gear 93 engages with the consecutive supply transmission gear 112, power is transmitted to the support shaft 51, which is provided at the proximal end of the arm member 52, through one intermediate gear 130, as shown in FIGS. 18A to 18C and 19A. Then, the rotary driving force is transmitted to the driving gear 66 through the power transmission gear 56.

3. Explanation of Control System

Next, an exemplary control system of the image forming apparatus 1 of the present embodiment will be described with reference to FIG. 20.

Figure 20:
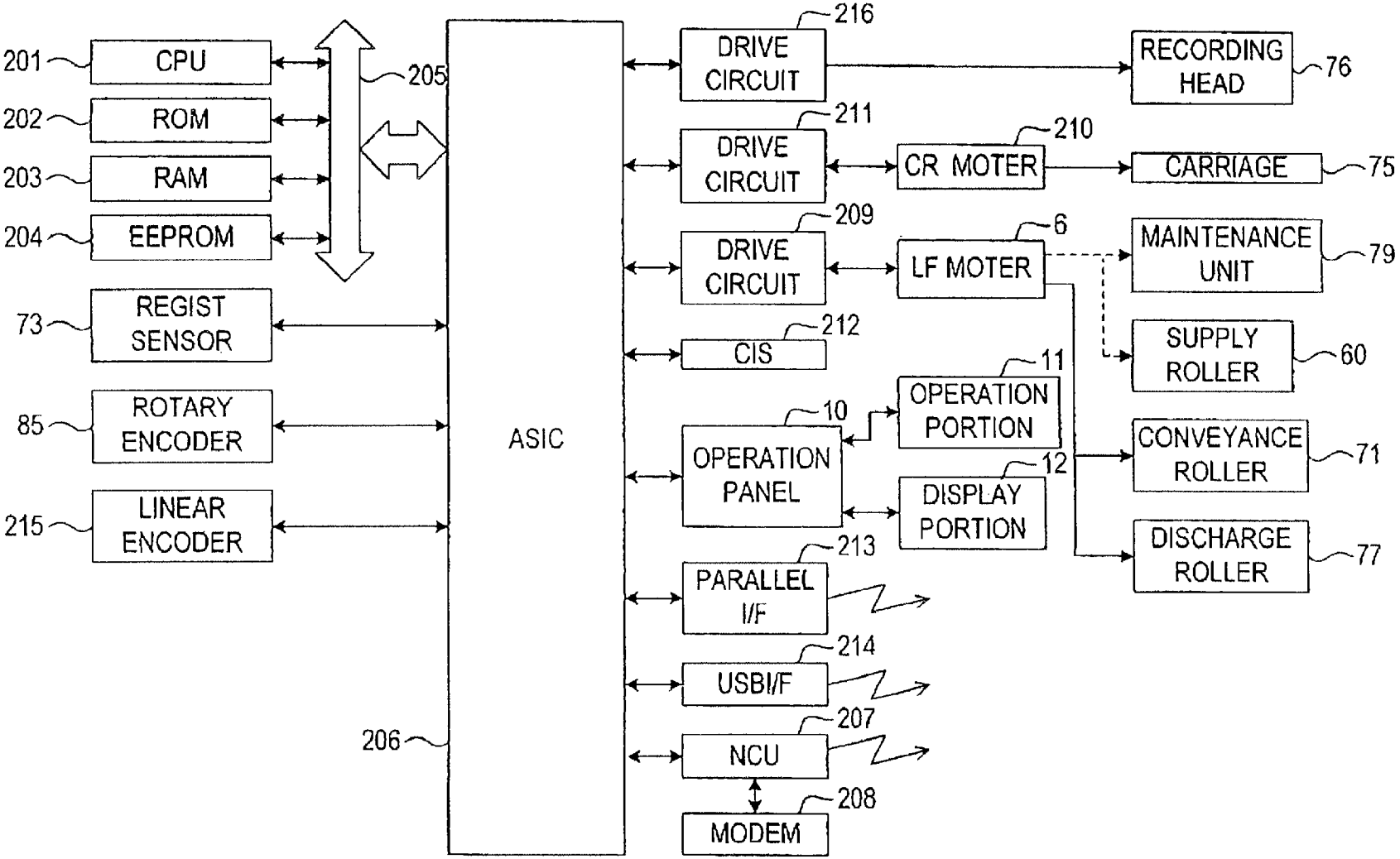
FIG. 20 is a block diagram showing a schematic configuration of a control system of the image forming apparatus.

As shown in FIG. 20, the image forming apparatus 1 is provided with a CPU 201, a ROM 202, a RAM 203 and an EEPROM 204, which are all connected to an ASIC (Application Specific Integrated Circuit) 206 through a bus 205.

The ROM 202 stores, for example, control programs to control various operations of the image forming apparatus 1. The RAM 203 is used as a storage area (a work area) that temporarily stores various data to be used when the CPU 201 executes a program.

An NCU (Network Control Unit) 207 is connected to the ASIC 206. A communication signal inputted from a public line through the NCU 207 is first demodulated by a MODEM 208 and then inputted to the ASIC 206. When an image data is transmitted by the ASIC 206 to an outside via facsimile or the like, the image data is first modulated to a communication signal by the MODEM 208 and then the communication signal is outputted to the public line through the NCU 207.

The ASIC 206, in accordance with a command from the CPU 201, generates signals, including a phase excitation signal to turn on electricity to the LF motor 6, and provides the signals to a drive circuit 209 for the LF motor 6 or a drive circuit 211 for a CR motor 210 (a motor for driving the carriage 75). Thus, the ASIC 206 provides a drive signal to the LF motor 6 or the CR motor 210 via the drive circuit 209 or the drive circuit 211, and thereby controls forward and reverse rotations, a stop operation and the like of the LF motor 6 or the CR motor.

A CIS (Contact Image Sensor) 212, an operation panel 10, a parallel interface 213 and an USB interface 214 are connected to the ASIC 206. The CIS 212 operates as an image reading device in the scanner unit 20. The operation panel 10 includes the operation portion 11 and the display portion 12. The parallel interface 213 and the USB interface 214 are used to perform transmission and reception of data through a parallel cable or a USB cable with an external information processing apparatus, such as a personal computer.

The regist sensor 73, the rotary encoder 85 and a linear encoder 215 to detect a position of the carriage 75 in the main scanning direction are connected to the ASIC 206.

A drive circuit 216 is designed to make the recording head 76 selectively discharge ink toward the recording medium at a predetermined timing. Specifically, the drive circuit 216 receives the signals, which are generated and outputted by the ASIC 206, and controls driving of the recording head 76 according to a drive control signal outputted from the CPU 201.

Figure 21:
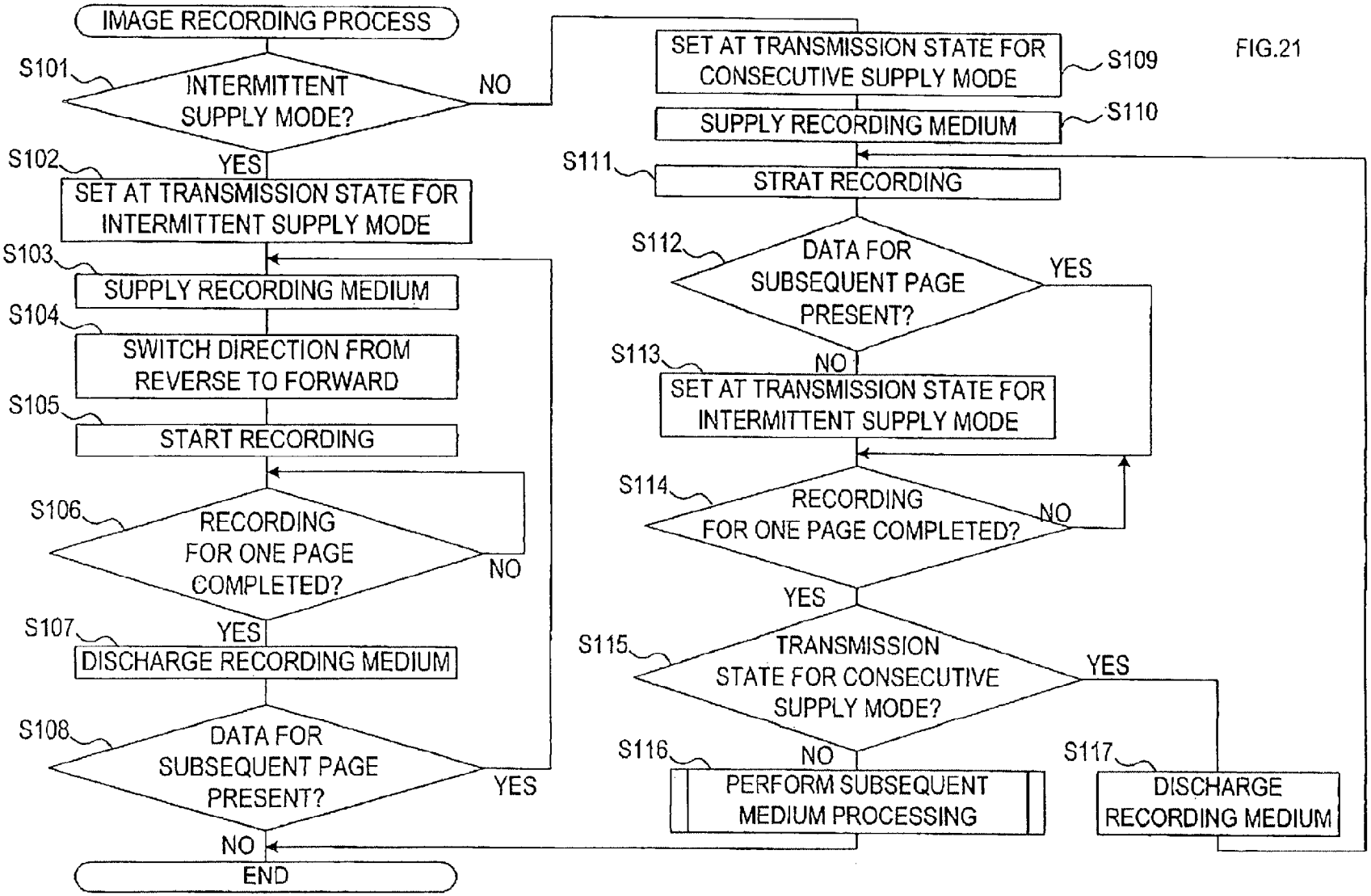
FIG. 21 is a flowchart of an image recording process.

Next, an image recording process performed by the CPU 201 will be discussed with reference to a flowchart in FIG. 21. The image recording process is started when an image recording command is inputted from an external information processing apparatus (e.g. a personal computer).

When the image recording process is started, a currently set supply mode is determined in S101. The image forming apparatus 1 of the present embodiment allows a user to select a supply mode for consecutively recording images on a plurality of sheets of the recording medium from the intermittent supply mode and the consecutive supply mode. The intermittent supply mode is a supply mode in which the recording medium conveyed from the supply tray 30 undergoes skew correction by the conveyance roller 71, and is further conveyed to the image recording unit 70 (a mode to prioritize accuracy of image recording). The consecutive supply mode is a supply mode in which the recording medium conveyed from the supply tray 30 is further conveyed to the image recording unit 70 without skew correction being performed by the conveyance roller 71 (a mode to prioritize reduction of time required for image recording).

When it is determined in S101 that the currently set supply mode is the intermittent supply mode, the process proceeds to S102.

In S102, the power transmission switching mechanism 90 is set at a transmission state for the intermittent supply mode. Specifically, the carriage 75 stopped at the waiting position (the third position (PO3)) is largely moved to the image recording region in the arrow C direction in FIG. 16A. Then, the first block 94 pushed by the first bias spring 96 is moved in the arrow C direction along with the restriction piece 102 in the circular groove portion 101*b*. When the carriage 75 come out of the circular groove portion 101*b*, the first block 94 is received by the first set portion 101*c*, and is retained at the first position (PO1). At the first position, the switching gear 93 engages with the intermittent supply transmission gear 111, and power is transmitted to the support shaft 51 of the supply unit 50 through the two intermediate gears 129*a*, 129*b* shown in FIG. 17A.

Subsequently in S103, the recording medium is supplied from the supply tray 30 to the image recording unit 70. Specifically, the LF motor 6 is rotated in a reverse direction, and the conveyance roller 71 is rotary driven in the reverse direction (in a counterclockwise direction in FIG. 17A) and the supply roller 60 is rotary driven in the forward direction (in the counterclockwise direction shown in FIG. 17A), as shown in FIG. 17A.

This makes the plurality of sheets of the recording medium stored in the supply tray 30 strike the guide plate 34 disposed on the rear end of the supply tray 30. An uppermost sheet of the recording medium, which is abutting the supply roller 60, is separated from the other sheets and is supplied (conveyed) to the conveyance path 5. Since the conveyance roller 71 is rotary driven in the reverse direction at this time, a leading end of the uppermost sheet of the recording medium enters a nip portion between the conveyance roller 71 and the driven roller 72 (and thus is prevented from passing therethrough). Thus, skew correction of the recording medium is performed.

Subsequently, in S104, the direction of the rotary driving force generated by the LF motor 6 is switched from reverse to forward. Specifically, the direction is switched when the recording medium has been conveyed by a predetermined amount since the leading end of the recording medium is detected by the regist sensor 73 (when the leading end of the recording medium has been conveyed to reach the conveyance roller 71).

Then, as shown in FIG. 17B, the conveyance roller 71 is rotary driven in the forward direction (in the clockwise direction in FIG. 17B), and the recording medium is pinched at the nip portion between the conveyance roller 71 and the driven roller 72. In this case, the supply roller 60 is made to be rotary driven in the reverse direction (in the clockwise direction in FIG. 17B). However, the supply roller 60 has the certain amount of play in the rotating direction, and thus is not rotary driven in the reverse direction immediately after the rotation of the LF motor 6 is switched from the reverse direction to the forward direction (a state shown in FIG. 6B). The supply roller 60 starts to be rotary driven in the reverse direction after a delay by the play (a state shown in FIG. 6A). This inhibits the supply roller 60 from hindering pinching of the recording medium by the conveyance roller 71 and the driven roller 72.

After the delay by the play, the supply roller 60 starts to be rotary driven in the reverse direction and attempts to convey the recording medium in a direction different from a conveyance direction by the conveyance roller 71 (see FIG. 6A). However, a conveyance force generated by the rotation of the conveyance roller 71 in the forward direction is larger than that of the supply roller 60 in the reverse direction. Accordingly, the conveyance of the recording medium by the conveyance roller 71 is not hindered.

In the image forming apparatus 1, rotary driving of the supply roller 60 results in application of a force, which urges the supply roller 60 to roll on the recording medium, to the arm member 52. Specifically, when the supply roller 60 is rotary driven in the forward direction, a component force of the force applied to the arm member 52 acts to press the supply roller 60 toward the recording medium. Accordingly, a pressing force becomes larger, and thus the conveyance force becomes larger.

In contrast, when the supply roller 60 is rotary driven in the reverse direction, a component force applied to the arm member 52 acts to separate the supply roller 60 from the recording medium. Accordingly, a pressing force becomes smaller, and thus the conveyance force becomes smaller. As a result, the conveyance of the recording medium by the conveyance roller 71 is not hindered even when the supply roller 60 is rotated in the reverse direction.

In S105, image recording on the recording medium is started. Specifically, an image is recorded by discharging ink from the nozzle of the recording head 76 onto a surface of the recording medium while forwarding the recording medium intermittently and reciprocating the carriage 76 in the main scanning direction.

In S106, it is determined whether or not recording for one page (for a sheet of the recording medium) has been completed. When it is determined that recording for one page been completed, the present process proceeds to S107.

In S107, the recording medium after the image recording is discharged to a front upper position of the supply tray 30. Specifically, the LF motor 6 is rotated in the forward direction by an appropriate step number, and the conveyance roller 71 and the discharge roller 77 are rotary driven in the forward direction by a predetermined amount.

In S108, it is determined whether or not image recording data for a subsequent page (for a following sheet of the recording medium) is present. When it is determined that image recording data for the subsequent page is present, the present process returns to S103, and the above-mentioned processings (S103 to S107) are performed.

When it is determined that image recording data for the subsequent page is not present in S108, the present image recording process is terminated.

On the other hand, when it is determined in S101 that the currently set supply mode is not the intermittent supply mode (i.e., the currently set supply mode is the consecutive supply mode), the present process proceeds to S109. In S109, the power transmission switching mechanism 90 is set at the transmission state for the consecutive supply mode.

Figure 18A:
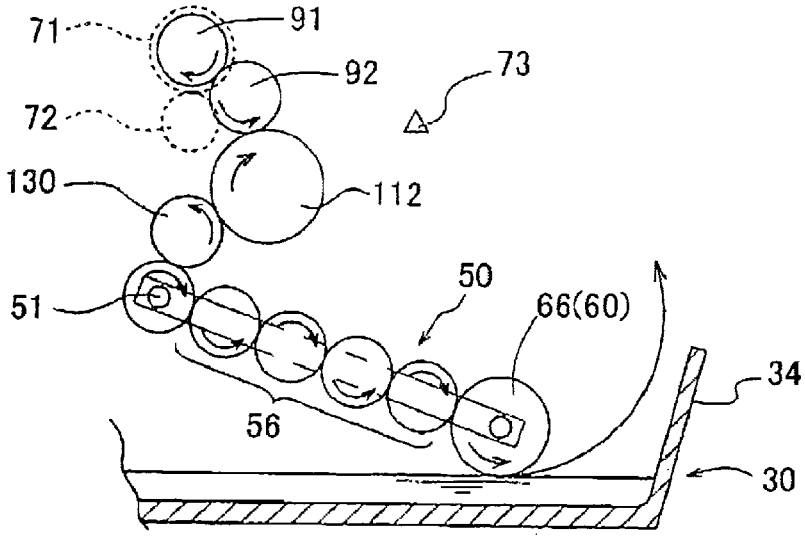
FIGS. 18A, 18B and 18C are schematic views explaining a rotary driving force transmission path in a consecutive supply mode.

Specifically, the carriage 75 stopped at the first position (PO1) is moved in the arrow E direction in FIG. 16A by a predetermined amount, and thereby the abutment piece 94*a* is pushed by the first engagement shoulder 75*a* of the carriage 75. When the abutment piece 94*a* is positioned at the second set portion 101*d* (the second position PO2), the switching gear 93 engages with the consecutive supply transmission gear 112. Then, power is transmitted to the support shaft 51 of the supply unit 50 through one intermediate gear 130 as shown in FIG. 18A. After that, even if the carriage 76 is moved in the arrow C direction (to the image recording region), the abutment piece 94 biased by the first bias spring 96 is retained at a low shoulder, i.e., the second set portion 101*d*.

Then, in S110, the recording medium is supplied from the supply tray 30 to the image recording unit 70. Specifically, the LF motor 6 is rotated in the forward direction, and the conveyance roller 71 is rotary driven in the forward direction (in the clockwise direction in FIG. 18A), as shown in FIG. 18A, and the supply roller 60 is rotary driven in the forward direction. Consequently, an uppermost sheet of the plurality of sheets of the recording medium stored in the supply tray 30 is separated from the other sheets and conveyed to the conveyance path 5.

Since the conveyance roller 71 is rotary driven in the forward direction, the recording medium passes between the conveyance roller 71 and the driven roller 72 without being affected by a regist operation, and is pinched by the conveyance roller 71 and the driven roller 72 when the leading end of the recording medium reaches the nip portion between the conveyance roller 71 and the driven roller 72.

Figure 18B:
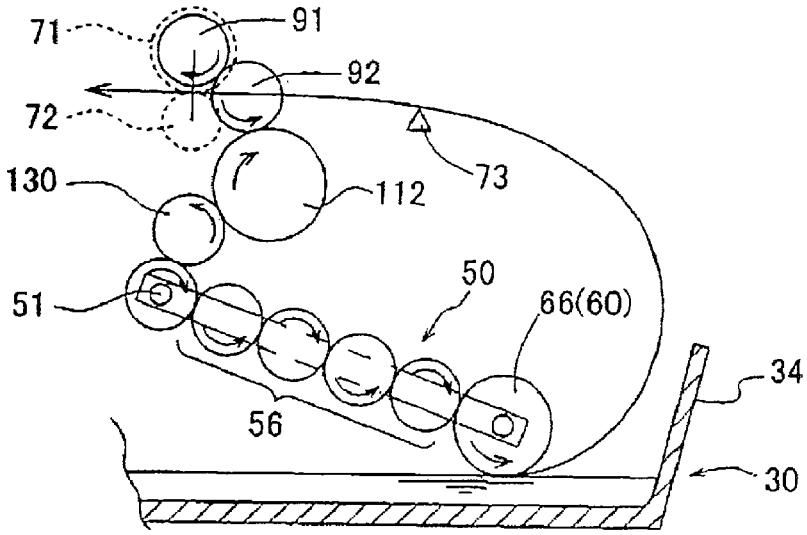
Figure 18C:
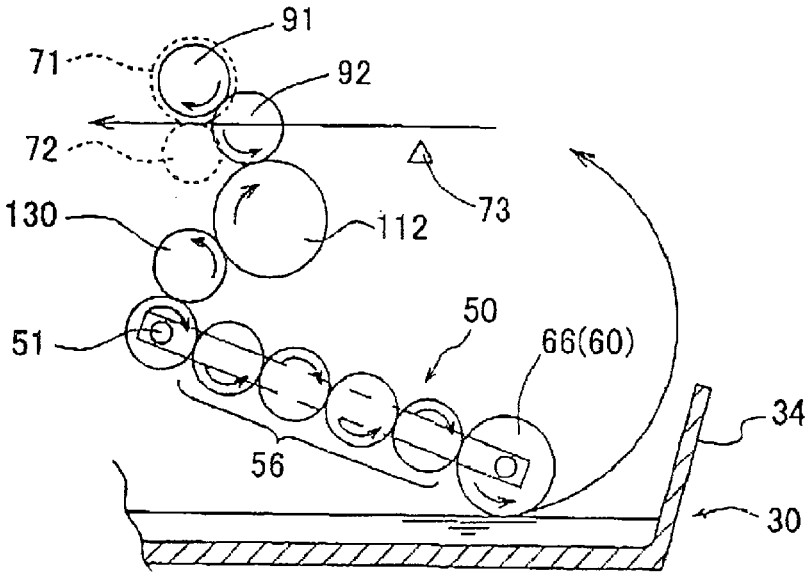

Even when one sheet of the recording medium is pinched by the conveyance roller 71 and the driven roller 72 and also abuts the supply roller 60, i.e., located over both of the conveyance roller 71 and the supply roller 60 (as shown in FIG. 18B), conveyance of the recording medium by the conveyance roller 71 is not hindered. Specifically, as discussed above, the conveyance speed of the recording medium by the conveyance roller 71 is designed to be faster than the conveyance speed of the recording medium by the supply roller 60.

Accordingly, the supply roller 60 is in a state of being pulled by the recording medium. In this state, a force in an opposite direction is applied to the arm member 62 contrary to a force due to the rotation of the supply roller 60 in the forward direction and causing the supply roller 60 to roll on the recording medium. The component force of the force in the opposite direction acts to separate the supply roller 60 from the recording medium. Consequently, the pressing force becomes smaller, and thus the conveyance force also becomes smaller. Therefore, even when the conveyance speed of the recording medium by the supply roller 60 is slow, the conveyance of the recording medium by the conveyance roller 71 is not hindered.

According to the image forming apparatus 1, the recording medium is also inhibited from being skewed continuously by such consecutive conveyance. When the recording medium being conveyed by the conveyance roller 71 abuts the supply roller 60 (i.e., the recording medium is located over both of the rollers 60, 71), the conveyance speed of the recording medium by the conveyance roller 71 is faster than that of the supply roller 60. Accordingly, the supply roller 60 is rotated ahead of the driving gear 66 by the play in the rotating direction since the supply roller 60 is pulled by the recording medium.

When a rear end of the recording medium being conveyed by the conveyance roller 71 leaves the supply roller 60, the supply roller 60 abuts a subsequent (a currently uppermost) recording medium. Since the supply roller 60 is rotated ahead of the driving gear 66 by the play in the rotating direction, the supply roller 60 is not immediately rotary driven in the forward direction. The supply roller 60 starts to be rotary driven after the delay of the play. It may, therefore, be possible to inhibit continuous occurrence of skew of the recording medium due to the consecutive conveyance of the recording medium by rotating both the supply roller 60 and the conveyance roller 71 in the forward direction.

In S111, image recording on the recording medium is started. Specifically, an image is recorded by discharging ink from the nozzle of the recording head 76 onto a surface of the recording medium while forwarding the recording medium intermittently and reciprocating the carriage 75 in the main scanning direction.

In S112, it is determined whether or not image recording data for a subsequent page (for a following sheet of the recording medium) is present. When it is determined that image recording data for the subsequent page is not present, the present process proceeds to S113.

In S113, the power transmission switching mechanism 90 is set at the transmission state for the intermittent supply mode, and the present process proceeds to S114.

On the other hand, when it is determined in S112 that image recording data for the subsequent page is present, the present process proceeds to S114.

In S114, it is determined whether or not recording for one page (for a sheet of the recording medium) has been completed. When it is determined that recording for one page been completed, the present process proceeds to S115.

In S115, it is determined whether or not the power transmission switching mechanism 90 is in the transmission state for the consecutive supply mode. When it is determined in S115 that the power transmission switching mechanism 90 is not in the transmission state for the consecutive supply mode (i.e., in the transmission state for the intermittent supply mode), the present process proceeds to S116.

Figure 22:
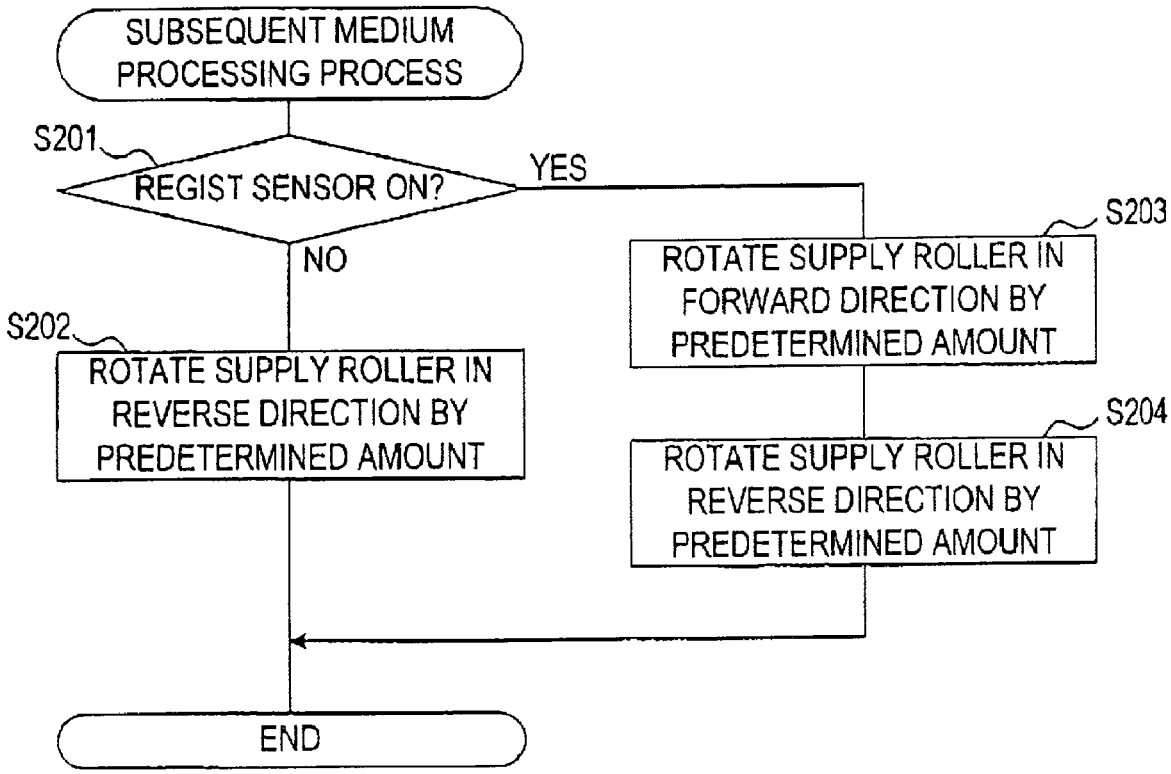
FIG. 22 is a flowchart of the subsequent medium processing process.

In S116, a subsequent medium processing is performed and then the image recording process is terminated. The details of the subsequent medium processing will be discussed later (FIG. 22).

On the other hand, when it is determined in S115 that the power transmission switching mechanism 90 is in the transmission state for the consecutive supply mode (i.e., when image recording data for the subsequent page is present), the present process proceeds to S117.

In S117, the recording medium after image recording is discharged and the subsequent recording medium is conveyed. Then, the present process is returned to S111. Specifically, the LF motor 6 is rotated in the forward direction continuously and a preceding sheet of the recording medium (the preceding page) is discharged while the subsequent sheet of the recording medium is conveyed to a recording start position (see FIG. 18C)

In the above described manner, the plurality of sheets of the recording medium may be conveyed continuously in the consecutive supply mode without temporarily stopping the recording medium by the conveyance roller 71. Thus, a high speed recording operation can be achieved.

Next, the subsequent medium processing performed in S116 of the image recording process (FIG. 21) will be discussed with reference to a flowchart of FIG. 22.

When the subsequent medium processing is started, it is determined in S201 whether or not the regist sensor 73 is on. Specifically, it is determined whether or not a leading end of a subsequent recording medium following the recording medium after the image recording has passed a position of the regist sensor 73.

When it is determined in S201 that the regist sensor 73 is not on (i.e., is off), the present process proceeds to S202. In S202, the LF motor 6 is rotated in the forward direction by an appropriate step number, and the supply roller 60 is rotary driven in the reverse direction by a predetermined amount. Then, the subsequent medium processing process is terminated.

In other words, as shown in FIG. 19A, when the leading end of the subsequent recording medium has not reached the position of the regist sensor 73, the subsequent recording medium is returned to the supply tray 30. The recording medium after the image recording is discharged by the rotations of the conveyance roller 71 and the discharge roller 77 in the forward direction.

On the other hand, when it is determined in S201 that the regist sensor 73 is on, the present process proceeds to S203. In S203, the LF motor 6 is rotated in the reverse direction by an appropriate step number, and the supply roller 60 is rotary driven in the forward direction by a predetermined amount. When the leading end of the subsequent recording medium has exceeded the position of the regist sensor 73, the leading end of the subsequent recording medium is struck against the conveyance roller 71, and thereby skew correction is performed.

Subsequently, in S204, the LF motor 6 is rotated in the forward direction by an appropriate step number, and the conveyance roller 71 and the discharge roller 77 are rotary driven in the forward direction by a predetermined amount. Then, the supply roller 60 is rotary driven in the reverse direction by a predetermined amount. As a result, as shown in FIG. 19B, the subsequent recording medium after skew correction is discharged, while a further subsequent recording medium is returned to the supply tray 30. Then, the present subsequent medium processing process is terminated.

As described above, when the leading end of the subsequent recording medium exceeds the position of the regist sensor 73 and is positioned downstream from the regist sensor 73 in the conveyance direction, the subsequent recording medium is conveyed in a discharge direction. In contrast, when the leading end of the subsequent recording medium has not reached the position of the regist sensor 73, the subsequent recording medium is returned toward the supply tray 30.

4. Advantage

In the image forming apparatus 1 of the present embodiment, as discussed above, the recording medium conveyed by the rotation of the supply roller 60 in the forward direction is conveyed through the conveyance roller 71, which is rotated in the forward direction, in the consecutive supply mode. When the rear end of the recording medium conveyed by the conveyance roller 71 leaves the supply roller 60, the supply roller 60 abuts the subsequent recording medium, and the subsequent recording medium is conveyed continuously.

That is, the present image forming apparatus 1 is capable of supplying (or conveying) the subsequent recording medium by the supply roller 60 while the recording medium is being conveyed by the conveyance roller 71. It may, therefore, be possible to perform image recording on a large amount of recording medium in a short time.

Moreover, the present image forming apparatus 1 is configured such that the conveyance speed of the recording medium by the conveyance roller 71 is faster than the conveyance speed of the recording medium by the supply roller 60. Accordingly, even when a preceding recording medium is delivered from the supply tray 30 with a rear end of the preceding recording medium overlapping a leading end of a subsequent recording medium, such an overlap may be eliminated before each of the recording mediums has been conveyed to the image recording position.

Furthermore, the supply roller 60 has the certain amount of play in the rotating direction in the image forming apparatus 1. It may, therefore, be possible to effectively suppress continuous occurrence of skew of the recording medium due to the consecutive conveyance of the recording medium as above.

When the recording medium being conveyed by the conveyance roller 71 abuts the supply roller 60, the conveyance speed of the recording medium by the conveyance roller 71 is faster than the conveyance speed of the recording medium by the supply roller 60. Accordingly, the supply roller 60 is pulled by the recording medium by an amount corresponding to the amount of the play in the rotating direction.

When a rear end of the recording medium being conveyed by the conveyance roller 71 leaves the supply roller 60, the supply roller 60 abuts a subsequent recording medium. Since the supply roller 60 is pulled by the recording medium by the amount corresponding to the amount of the play in the rotating direction, the supply roller 60 is not immediately rotated in the forward direction but starts to be rotated after the delay of the play.

It may, therefore, be possible to significantly reduce or inhibit the subsequent recording medium from being skewed. Thus, it may be possible, according to the image forming apparatus 1, to effectively suppress continuous occurrence of skew of the recording medium due to the consecutive conveyance of the recording medium by rotating both of the supply roller 60 and the conveyance roller 71 in the forward direction.

In the image forming apparatus 1, when the supply roller 60 is rotated in the forward direction, a force to urge the supply roller 60 to roll on the recording medium is applied to the arm member 52. Then, a component force of the force applied to the arm member 52 acts to press the supply roller 60 toward the recording medium, and thereby the conveyance force becomes larger.

In contrast, when the supply roller 60 is pulled by the recording medium, a force in an opposite direction is applied to the arm member 52. Then, a component force of the force in the opposite direction acts to separate the supply roller 60 from the recording medium, and thereby the conveyance force becomes smaller.

According to the present image forming apparatus 1, therefore, it may be possible to ensure a conveyance force required to supply (convey) the recording medium stored in the supply tray 30 when the supply roller 60 is rotary driven in the forward direction, and also may be possible not to hinder the conveyance of the recording medium by the conveyance roller 71 when the supply roller 60 is pulled by the recording medium being conveyed by the conveyance roller 71.

Further, according to the present image forming apparatus 1, the recording medium conveyed by the rotation of the supply roller 60 in the forward direction is interrupted to pass through by the conveyance roller 71 rotating in the reverse direction and undergoes skew correction, in the intermittent supply mode.

At a timing when the recording medium conveyed by the supply roller 60 reaches the conveyance roller 71, the direction of the rotary driving force generated by the LF motor 6 is switched from reverse to forward (the CPU 201 executes the processing in S104). Then, the conveyance roller 71 is rotated in the forward direction, and the recording medium after skew correction is conveyed through the conveyance roller 71.

The supply roller 60 having a certain amount of play in the rotating direction is not rotated in the reverse direction immediately after the rotation of the LF motor 6 is switched from the reverse direction to the forward direction. The supply roller 60 starts to be rotated in the reverse direction after a delay by the play. It may, therefore, be possible to prevent the recording medium from being pulled back due to the rotation of the supply roller 60 in the reverse direction before the conveyance roller 71 becomes ready to convey the recording medium.

According to the present image forming apparatus 1, as described above, the supply mode of the recording medium may be switched between the consecutive supply mode to convey the recording medium continuously and the intermittent supply mode to convey the recording medium while skew correction is being performed by the conveyance roller 71. This may be achieved simply by switching the power transmission switching mechanism 90 into the transmission state for the consecutive supply mode and the transmission state for the intermittent supply mode. Thus, it may be possible to perform image recording in an appropriate supply mode in accordance with a status of use.

5. Modification

Although one embodiment of the present invention has been described as above, it is to be understood that the present invention may be embodied in various forms.

For example, in the image forming apparatus 1 of the present embodiment, a certain degree of freedom is given to the angle of the rotating shaft of the supply roller 60 by forming a clearance between the shaft 65 of the supply roller 60 and the axial support member 55 of the arm member 52. However, the certain degree of freedom may be given to the angle of the rotating shaft of the supply roller 60 by allowing flexible movement of the distal end of the arm member 52.

Moreover, the certain degree of freedom may be given to angles in all directions as in the image forming apparatus 1 of the present embodiment, or to an angle in a specific direction of the rotating shaft of the supply roller 60. The angle in a specific direction may be, for example, an angle along a plane parallel with the recording medium (an angle along the front and back direction) or an angle along a plane perpendicular to the recording medium (an angle along the up and down direction).

In the image forming apparatus 1, the arm member 52 is biased by the second twist spring 58, which is provided at the distal end of the arm member 52, abutting the frame 4 and being elastically deformed. However, the arm member 52 may be biased by a spring 58, which is provided to the frame 4, abutting the arm member 52 and being elastically deformed.

The present invention is applied to an image forming apparatus that performs image recording in an ink-jet method in the present embodiment. However, the present invention may be applied to, for example, an image forming apparatus that performs image recording in a laser method.

What is claimed is:

1. An image forming apparatus comprising:

a medium storage portion that is capable of storing a plurality of recording mediums in a stacked manner;

a supply roller that is disposed so as to abut an uppermost recording medium of the plurality of recording mediums stored in the medium storage portion, and is configured to be rotary driven in a forward direction as a rotating direction to convey the recording mediums at a first conveyance speed to a position for image formation, thereby to supply the abutting uppermost recording medium to a conveyance path, wherein the supply roller includes:

a shaft; and a drive member having a hole through which the shaft is inserted and a cutout adjacent the hole including opposing engagement portions configured to engage a portion of the shaft;

a conveyance roller that is disposed in the conveyance path and is configured to be rotary driven in a forward direction as a rotating direction to convey the recording mediums at a second conveyance speed to a position for image formation, thereby to allow passage of the uppermost recording medium conveyed by the supply roller;

a drive device that generates a rotary driving force; and a transmission device that transmits the rotary driving force generated by the drive device to the supply roller and the conveyance roller, thereby to cause both of the supply roller and the conveyance roller to rotate in the forward direction, wherein the second conveyance speed is greater than the first conveyance speed, and wherein the supply roller has a predetermined play in a rotating direction of the supply roller, the predetermined play being provided between the shaft and the drive member between the opposing engagement portions of the cutout.

2. The image forming apparatus as set forth in claim 1, wherein one of the shaft and the drive member includes a protrusion, and the other includes a cutout receiving the protrusion, and wherein the protrusion is movable within a predetermined angular range in the rotating direction of the supply roller in the cutout, thereby to achieve the play.

3. The image forming apparatus as set forth in claim 1, further comprising a support device that is pivotable about a pivot shaft and supports the supply roller in a rotatable manner at a distal end of the support device, the pivot shaft being substantially parallel with a rotating shaft of the supply roller and being positioned above the recording mediums stored in the medium storage portion and on an opposite side of the rotating shaft of the supply roller in a conveyance direction of the recording medium by the supply roller.

4. The image forming apparatus as set forth in claim 3, further comprising: a biasing member that causes the support device to rotate around the pivot shaft in such a rotating direction that the supply roller is pressed against the recording mediums stored in the medium storage portion.

5. The image forming apparatus as set forth in claim 1, wherein the drive device is configured to generate rotary driving forces in both forward and reverse directions.

6. The image forming apparatus as set forth in claim 5, wherein the transmission device comprises:

a first transmission path configured to transmit the rotary driving force so as to rotate both of the supply roller and the conveyance roller in the forward direction;

a second transmission path configured to transmit the rotary driving force so as to rotate one of the supply roller and the conveyance roller in the forward direction and the other in the reverse direction; and a controller configured to switch between the first transmission path and the second transmission path.

7. The image forming apparatus as set forth in claim 6, wherein the conveyance roller is configured to inhibit passage of the recording medium conveyed by the supply roller when the conveyance roller is rotated in the reverse direction.

8. The image forming apparatus as set forth in claim 6, wherein the conveyance roller is configured to inhibit passage of the recording medium conveyed by the supply roller when the conveyance roller is stopped.

9. The image forming apparatus as set forth in claim 6, wherein the image forming apparatus is configured to operate in a consecutive supply mode when the driving force is transmitted via the first transmission path, in which the recording mediums are supplied consecutively, and in an intermittent supply mode when the driving force is transmitted via the second transmission path, in which the recording medium is supplied intermittently;

wherein the controller is configured to switch the operation of the image forming apparatus between the intermittent supply mode and the consecutive supply mode;

wherein in the consecutive supply mode, the predetermined amount of play of the supply roller is configured to delay the rotation of the supply roller in the forward direction after supplying one recording medium to the conveyance path to inhibit skew of a subsequent recording medium stored in a medium storage portion to be supplied by the supply roller to the conveyance path; and wherein in the intermittent supply mode:

the conveyance roller is configured to be rotary driven in the reverse direction to inhibit skew of the recording medium conveyed by the supply roller rotating in the forward direction; and wherein the predetermined play of the supply roller is configured to delay the rotation of the supply roller in the reverse direction after the rotation of conveyor roller in the forward direction upon switching the direction of the driving force of the drive device.

* * * * *